US009441500B2

(12) United States Patent
Hori et al.

(10) Patent No.: US 9,441,500 B2
(45) Date of Patent: Sep. 13, 2016

(54) STEAM TURBINE CASING POSITION ADJUSTING APPARATUS

(75) Inventors: Takumi Hori, Tokyo (JP); Megumu Tsuruta, Tokyo (JP); Shin Asano, Tokyo (JP); Tamiaki Nakazawa, Tokyo (JP); Ryokichi Hombo, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 636 days.

(21) Appl. No.: 13/817,983

(22) PCT Filed: Nov. 2, 2011

(86) PCT No.: PCT/JP2011/075356

§ 371 (c)(1),
(2), (4) Date: Feb. 20, 2013

(87) PCT Pub. No.: WO2012/132085

PCT Pub. Date: Oct. 4, 2012

(65) Prior Publication Data

US 2013/0149117 A1 Jun. 13, 2013

(30) Foreign Application Priority Data

Mar. 31, 2011 (JP) ..... 2011-081092
Apr. 8, 2011 (JP) ..... 2011-086339
Apr. 8, 2011 (JP) ..... 2011-086340

(51) Int. Cl.
*F01D 25/24* (2006.01)
*F01D 11/20* (2006.01)
(Continued)

(52) U.S. Cl.
CPC ..... *F01D 11/20* (2013.01); *F01D 11/22* (2013.01); *F01D 21/08* (2013.01); *F01D 25/24* (2013.01);
(Continued)

(58) Field of Classification Search
CPC ..... F01D 11/20; F01D 11/22; F01D 21/08; F01D 25/24; F01D 25/26; F01D 25/28; F05D 2220/31; F05D 2260/57; F05D 2270/60; F05D 2270/80; F05D 2270/821
See application file for complete search history.

(56) References Cited

U.S. PATENT DOCUMENTS 3,837,164 A * 9/1974 Carr ..... F02C 7/20 415/126
3,908,444 A * 9/1975 Peter ..... G01B 11/14 250/224
(Continued)

FOREIGN PATENT DOCUMENTS

CH EP 2821593 A1 * 1/2015 ..... F01D 5/28
CN 1051961 6/1991
(Continued)

OTHER PUBLICATIONS

Extended European Search Report issued Oct. 24, 2014 in corresponding European patent application No. 11862583.9.
(Continued)

*Primary Examiner* — Thomas Denion
*Assistant Examiner* — Matthew T Largi
(74) *Attorney, Agent, or Firm* — Wenderoth, Lind & Ponack, L.L.P.

(57) ABSTRACT

A steam turbine casing position adjusting apparatus capable of employing a compact low-resolution actuator is provided. A steam turbine casing position adjusting apparatus 40 includes turbine casings 21 and 37, a rotor 23, and actuators 14 and 15 that move the turbine casings 21 and 37 in the axial direction. The actuators 14 and 15 are disposed radially outside outer peripheries forming the turbine casings 21 and 37.

12 Claims, 21 Drawing Sheets

(51) Int. Cl.

| | |
|---|---|
| ***F01D 11/22*** | (2006.01) |
| ***F01D 21/08*** | (2006.01) |
| ***F01D 25/26*** | (2006.01) |
| ***F01D 25/28*** | (2006.01) |

(52) U.S. Cl.

CPC ..... *F01D 25/26* (2013.01); *F01D 25/28* (2013.01); *F05D 2220/31* (2013.01); *F05D 2260/57* (2013.01); *F05D 2270/60* (2013.01); *F05D 2270/80* (2013.01); *F05D 2270/821* (2013.01)

(56) References Cited

U.S. PATENT DOCUMENTS

| | | | | |
|---|---|---|---|---|
| 4,149,826 | A | 4/1979 | Torstenfelt | |
| 4,502,046 | A * | 2/1985 | Wonn | F01D 11/025 340/679 |
| 4,934,192 | A * | 6/1990 | Jenkins | G01H 11/02 73/660 |
| 5,051,061 | A * | 9/1991 | Meylan | F01D 25/162 248/901 |
| 5,056,986 | A * | 10/1991 | Silvestri, Jr. | F01D 5/225 324/207.24 |
| 5,330,320 | A | 7/1994 | Mansson | |
| 6,092,986 | A | 7/2000 | Oeynhausen et al. | |
| 2009/0064522 | A1* | 3/2009 | Herron | G01B 21/16 33/655 |
| 2010/0050404 | A1* | 3/2010 | Ichiryu | F01D 25/26 29/281.5 |
| 2010/0241393 | A1* | 9/2010 | Ihara | G01B 5/252 702/150 |
| 2011/0020117 | A1* | 1/2011 | Kondo | F01D 25/265 415/182.1 |

FOREIGN PATENT DOCUMENTS

| | | | |
|---|---|---|---|
| CN | 1225705 | | 8/1999 |
| CN | 1880732 | | 12/2006 |
| FR | 1337907 | | 9/1963 |
| JP | 59-18207 | | 1/1984 |
| JP | 61-41802 | | 3/1986 |
| JP | 3-67002 | | 3/1991 |
| JP | 4-132805 | | 5/1992 |
| JP | 04132805 | A * | 5/1992 |
| JP | 10-169407 | | 6/1998 |
| JP | 11-210406 | | 8/1999 |
| JP | 2000-282807 | | 10/2000 |
| JP | 2001-508146 | | 6/2001 |
| JP | 2009-097509 | | 5/2009 |
| WO | 93/20335 | | 10/1993 |

OTHER PUBLICATIONS

International Search Report issued Feb. 21, 2012 in International (PCT) Application No. PCT/JP2011/075356.

Office Action issued Mar. 31, 2014 in corresponding Korean patent application No. 10-2013-7003813 with English translation.

Decision to Grant a Patent issued Mar. 11, 2014 in corresponding Japanese patent application No. 2013-507044.

Office Action issued Jul. 25, 2014 in corresponding Chinese patent application No. 201180040600.5 (with English translation).

Notice of Allowance issued Dec. 18, 2014 in corresponding Korean patent application No. 10-2013-7003813.

Notification of the Decision to Grant a Patent Right for Patent for Invention issued Dec. 18, 2015 in corresponding Chinese patent application No. 201180040600.5 (with English translation).

* cited by examiner

STEAM TURBINE CASING POSITION ADJUSTING APPARATUS

TECHNICAL FIELD

The present invention relates to a steam turbine casing position adjusting apparatus used in a power plant etc.

BACKGROUND ART

In recent years, along with the increasing size of casings of steam turbines and the increasing temperature of the operating conditions, the length and the diameter of rotors tend to become larger and larger. This considerably increases a thermal elongation difference due to the relative thermal expansion of the turbine casing (inner casing) and the rotor, generated when the steam turbine is started up and is operated with a low load. For example, in a low-pressure turbine 5*b* disclosed in PTL 1, a thermal elongation difference due to the relative thermal expansion of a rotor and an inner casing of the low-pressure turbine 5*b*, which is the farthest from a thrust bearing 18 or 18*a*, is increased considerably.

Thus, instead of using a casing position adjusting apparatus 18 disclosed in PTL 2, a recently proposed steam turbine casing position adjusting apparatus 80 moves an inner casing (turbine casing) 21 in the axial direction by using actuators 20 having rods 26 that advance and recede in the axial direction of a rotor 23, as shown in FIG. 37 or 38, thus reducing a thermal elongation difference due to the relative thermal expansion of the inner casing 21 and the rotor 23.

CITATION LIST

Patent Literature

{PTL 1} Japanese Unexamined Patent Application, Publication No. 2000-282807

{PTL 2} Japanese Unexamined Utility Model Application, Publication No. Sho 61-41802

SUMMARY OF INVENTION

Technical Problem

In a steam turbine casing position adjusting apparatus that moves a turbine casing in the axial direction by using an actuator, instead of using the casing position adjusting apparatus 18 disclosed in PTL 2, thus reducing a thermal elongation difference due to the relative thermal expansion of the turbine casing and a rotor, however, the actuator is provided at a position indicated by reference numeral 18 in FIG. 1 of PTL 2, specifically, at a position closer to a center line C extending in the axial direction of a turbine casing 58, as shown in FIG. 5, in other words, at a position where the length of a perpendicular line (the distance) from the distal end of a rod 38 constituting an actuator 59 to the center line C becomes L. Therefore, even when the rod 38 is made to advance and recede by a small amount, the turbine casing 58 is rotated (yawed) about the center of gravity G of the turbine casing 58. Thus, there is a problem in that, in order to suppress the rotation (yawing) of the turbine casing 58 to a permitted value or lower, the actuator 59 requires an extremely high resolution (minimum motion unit of the actuator), thus requiring adoption of an expensive actuator, which increases the cost.

Furthermore, when the actuator 59 is provided at the position shown in FIG. 5, specifically, at the position where it is affected by the influence of a thermal elongation of the turbine casing 58 in the axial direction due to thermal expansion thereof, the thermal elongation of the turbine casing 58 in the axial direction due to thermal expansion thereof is absorbed by making the rod 38 of the actuator 59 recede in the axial direction. Thus, there is a problem in that the actuator 59 requires a function for making the rod 38 advance and recede by a large amount in the axial direction, thus requiring adoption of a large-scale actuator with a large stroke, which increases the size in the axial direction.

Furthermore, when the actuator 59 is disposed on an end surface of the turbine casing 58, shown in FIG. 5, there is a problem in that the size of the steam turbine is increased in the axial direction. In particular, in a power plant where a plurality of steam turbines are disposed in the axial direction of the steam turbines, the length of the whole plant in the axial direction is increased in proportion to the number of steam turbines.

Note that reference numeral 39 in FIG. 5 denotes a rotor.

PTL 1 merely discloses an elongation difference reducing apparatus for reducing the thermal elongation difference between a stationary part and a rotary part located on a side of the thrust bearing 18 or 18*a* where a high-pressure turbine 3, an ultrahigh-pressure turbine 2, and super-ultrahigh-pressure turbines 1*a* and 1*b* are provided, specifically, the thermal elongation difference due to the relative thermal expansion of a turbine casing (inner casing) and a rotor, and does not consider the thermal elongation difference due to the relative thermal expansion of the inner casing of the low-pressure turbine 5*b* and the rotor, which has recently become a problem.

Even if it is possible to provide the elongation difference reducing apparatus disclosed in PTL 1 on the other side of the thrust bearing 18 or in a where intermediate-pressure turbines 4*a* and 4*b* and low-pressure turbines 5*a* and 5*b* are provided and to reduce the thermal elongation difference due to the relative thermal expansion of the inner casing of the low-pressure turbine 5*b* and the rotor, elongation difference gauges 24, 25, and 27 disclosed in PTL 1 measure only axiswise elongations of the rotor exposed outside (at the outside of) turbine casings (outer casings). Therefore, it is impossible to accurately measure the thermal elongation difference due to the relative thermal expansion of the turbine casing (inner casing) and the rotor, and the improvement in efficiency of the turbine generated by reducing the clearance between the rotating part and the stationary part, specifically, the clearance between the turbine casing inner casing) and the rotor, is limited.

In the steam turbine casing position adjusting apparatus 80 shown in FIGS. 37 and 38, an arm 27 that extends from a portion of an outer peripheral surface (outer surface) of the inner casing 21 located at the axiswise middle of the inner casing 21 toward one side of the inner casing 21 (rightward in FIG. 37: upward in FIG. 38) and an arm 28 that extends from a portion of the outer peripheral surface (outer surface) of the inner casing 21 located at the axiswise middle of the inner casing 21 toward the other side of the inner casing 21 (leftward in FIG. 37: downward in FIG. 38) are supported on grounds G (see FIG. 37) (on which the outer casing 22 is installed) via axial-direction guides 81. Furthermore, the distal ends of the rods 26 constituting the actuators 20 are connected to the arms 27 and 28.

Note that the arm 27 and the arm 28 are provided in a horizontal plane that includes the central line C1, which extends in the axial direction of the inner casing 21, on opposite sides with the central axis C1 therebetween (at positions 180 degrees away from each other in the circumferential direction).

Furthermore, the actuators 20 are fixed to the outer casing 22 that is provided (disposed) so as to surround the circumference (outer side) of the inner casing 21 (or fixed to the grounds G on which the outer casing 22 is installed) and move the inner casing 21 in the axial direction with respect to the outer casing 22 and the rotor 23. The actuators 20 each include a cylinder 24 that extends in the axial direction, a piston 25 that reciprocates in the axial direction, and the rod 26 that is fixed to one end surface of the piston 25 and that advances and recedes in the axial direction.

Then, the actuators 20 are provided in a horizontal plane that includes the central line C1, which extends in the axial direction of the inner casing 21, on opposite sides with the central axis C1 therebetween (at positions 180 degrees away from each other in the circumferential direction).

However, the axial-direction guides 81, shown in FIG. 37, merely have a function for guiding the arms 27 and 28, which extend from the inner casing 21 toward both sides (both outer sides), in the axial direction. Thus, there is a possibility that excess loads are applied to the axial-direction guides 81 because of thermal elongations of the inner casing 21 in radial directions due to thermal expansion thereof, as indicated by solid arrows in FIG. 37, thereby damaging the axial-direction guides 81.

Furthermore, with respect to the actuators 20 fixed to the cuter casing 22 (or fixed to the grounds G on which the outer casing 22 is installed), the arms 27 and 28 are moved outward in the radial direction together with the inner casing 21, which thermally elongates in the radial direction. Thus, there is a possibility that excess loads are applied to joint parts between the distal ends of the rods 26 constituting the actuators 20 and the arms 27 and 28, thereby damaging the joint parts between the distal ends of the rods 26 constituting the actuators 20 and the arms 27 and 28.

Note that reference numeral 82 in FIG. 37 denotes an axial-direction guide (rail) that guides, in the axial direction, a convex portion 83 that protrudes vertically downward from a lower surface (bottom surface) of the inner casing 21 along the axial direction of the inner casing 21.

The present invention has been made in view of such circumstances, and an object thereof is to provide a steam turbine casing position adjusting apparatus capable of employing a compact low-resolution actuator.

A further object thereof is to provide a steam turbine casing position adjusting apparatus capable of reducing the clearance between a turbine casing and a rotor and improving the turbine efficiency.

A further object thereof is to provide a steam turbine casing position adjusting apparatus capable of permitting (absorbing) a thermal elongation of the turbine casing (for example, inner casing) in the radial direction due to thermal expansion thereof.

Solution to Problem

In order to solve the above-described problems, the present invention employs the following solutions.

The present invention provides a steam turbine casing position adjusting apparatus including: a turbine casing; a rotor; and an actuator that moves the turbine casing in an axial direction, in which the actuator is disposed radially outside an outer peripheral surface forming the turbine casing.

According to the steam turbine casing position adjusting apparatus of the present invention, for example, as shown in FIG. 4, the actuator is provided at a position away from a central line C1 that extends in the axial direction of the turbine casing, specifically, at a position where the length of a perpendicular (the distance) from the distal end of the rod 26 of the actuator 14 or 15 to the central line C1 becomes L1 (>L). Thus, even if the rod 26 is made to advance and recede by a large amount, rotation (yawing) of the turbine casing about the center of gravity G is suppressed.

Thus, the actuator 14 or 15 does not require extremely high resolution in order to suppress the rotation (yawing) of the turbine casing to a permitted value or lower, thus eliminating the need to adopt an expensive actuator, as the actuator 14 or 15, which avoids high cost (achieves a reduction in cost).

Furthermore, according to the steam turbine casing position adjusting apparatus of the present invention, because the actuator is not disposed on an end surface of the turbine casing 58 shown in FIG. 5, for example, it is possible to avoid an increase in the size of the steam turbine in the axial direction. In particular, in a power plant where a plurality of steam turbines are disposed in the axial direction of the steam turbines, an increase in the length of the whole plant in the axial direction can be avoided.

The present invention provides a steam turbine casing position adjusting apparatus including: an outer casing; an inner casing; a rotor; and an actuator that moves the inner casing in an axial direction, in which the actuator is disposed radially outside an outer peripheral surface forming the inner casing and radially inside an inner peripheral surface forming the outer casing.

According to the steam turbine casing position adjusting apparatus of the present invention, for example, as shown in FIG. 4, the actuator is provided at the position away from the central line C1 that extends in the axial direction of the inner casing, specifically, at the position where the length of a perpendicular (the distance) from the distal end of the rod 26 of the actuator 14 or 15 to the central line C1 becomes L1 (>L). Thus, even if the rod 26 is made to advance and recede by a large amount, rotation (yawing) of the inner casing about the center of gravity G is suppressed.

Thus, the actuator 14 or 15 does not require extremely high resolution in order to suppress the rotation (yawing) of the turbine casing to a permitted value or lower, thus eliminating the need to adopt an expensive actuator, as the actuator 14 or 15, which avoids high cost (achieves a reduction in cost).

Furthermore, according to the steam turbine casing position adjusting apparatus of the present invention, because the actuator is not disposed on an end surface of the turbine casing 58 shown in FIG. 5, for example, it is possible to avoid an increase in the size of the steam turbine in the axial direction. In particular, in a power plant where a plurality of steam turbines are disposed in the axial direction of the steam turbines, an increase in the length of the whole plant in the axial direction can be avoided.

Furthermore, according to the steam turbine casing position adjusting apparatus of the present invention, the actuator is disposed in a space formed between the outer peripheral surface (outer surface) of the inner casing and the inner peripheral surface (inner surface) of the outer casing, specifically, radially inside the inner peripheral surface of the outer casing.

Thus, it is possible to avoid an increase in the size of the steam turbine in the radial direction.

The present invention provides a steam turbine casing position adjusting apparatus including: an outer casing; an inner casing; a rotor; and an actuator that moves the inner casing in an axial direction, in which the actuator is disposed radially outside an outer peripheral surface forming the outer casing.

According to the steam turbine casing position adjusting apparatus of the present invention, for example, as shown in FIG. 4, the actuator is provided at the position away from the central line C1 that extends in the axial direction of the outer casing, specifically, at the position where the length of a perpendicular (the distance) from the distal end of the rod 26 of the actuator 14 or 15 to the central line C1 becomes L1 (>L). Thus, even if the rod 26 is made to advance and recede by a large amount, rotation (yawing) of the outer casing about the center of gravity G is suppressed.

Thus, the actuator 14 or 15 does not require extremely high resolution in order to suppress the rotation (yawing) of the turbine casing to a permitted value or lower, thus eliminating the need to adopt an expensive actuator, as the actuator 14 or 15, which avoids high cost (achieves a reduction in cost).

Furthermore, according to the steam turbine casing position adjusting apparatus of the present invention, because the actuator is not disposed on an end surface of the turbine casing 58 shown in FIG. 5, for example, it is possible to avoid an increase in the size of the steam turbine in the axial direction. In particular, in a power plant where a plurality of steam turbines are disposed in the axial direction of the steam turbines, an increase in the length of the whole plant in the axial direction can be avoided.

Furthermore, according to the steam turbine casing position adjusting apparatus of the present invention, the actuator is provided outside the outer casing, so that it is not exposed to high-temperature steam.

Thus, it is possible to reduce the occurrence of thermal damage and failure of the actuator, to lengthen the life thereof, and to improve the reliability of the actuator.

In the above-described steam turbine casing position adjusting apparatus, it is more preferred that the actuator be disposed in a recess that is provided in a circumferential direction at an axiswise middle portion of the outer casing.

According to this steam turbine casing position adjusting apparatus, the actuator is disposed in the recess (constricted portion), which is provided on the outer casing, specifically, in a dead space formed at a lateral center portion of the outer casing, in other words, radially inside the outer peripheral surface of the outer casing.

Thus, it is possible to suppress an increase in the size of the steam turbine in the radial direction, compared with a case where the actuator is disposed outside the outer casing that is not provided with the recess.

In the above-described steam turbine casing position adjusting apparatus, it is more preferred that a distal end of a rod constituting the actuator be connected to an arm that is fixed to a portion of an outer peripheral surface of the inner casing that is located at an axiswise middle of the inner casing and that extends toward a radially outer side of the inner casing.

According to this steam turbine casing position adjusting apparatus, for example, as shown in FIG. 4, the actuator is provided at the position where it is not affected by a thermal elongation of the inner casing in the axial direction due to thermal expansion thereof, specifically, at the position where the influence of a thermal elongation of the inner casing in the axial direction due to thermal expansion thereof can be ignored (need not be considered).

Thus, the actuator does not require a function for making the rod recede by a large amount in the axial direction to absorb a thermal elongation of the inner casing in the axial direction due to thermal expansion thereof, thus eliminating the need to adopt a large-scale actuator with a large stroke, as the actuator, which avoids an increase in size in the axial direction.

In the above-described steam turbine casing position adjusting apparatus, it is more preferred that the steam turbine casing position adjusting apparatus further include: a sensor that is fixed to the inner casing or a ground on which the outer casing is installed; a calculator that calculates a thermal elongation difference of the rotor in the axial direction with respect to the inner casing and an angle of inclination of the rotor with respect to the inner casing, based on data sent from the sensor; and a controller that controls the actuator such that the relative position relation between the inner casing and the rotor is not changed by canceling the thermal elongation difference and the angle of inclination calculated by the calculator.

According to this steam turbine casing position adjusting apparatus, the actuator is controlled such that the thermal elongation difference of the rotor in the axial direction with respect to the inner casing and the angle of inclination of the rotor with respect to the inner casing are cancelled out (offset: set to zero); thus, even in the hot state where the steam turbine ST is operated (in the state in which the thermal elongation difference and/or the angle of inclination has been produced), the relative position relation of the inner casing and the rotor is maintained unchanged (so as to be stabilized).

Thus, it is possible to reduce the clearance between the turbine casing and the rotor and to improve the efficiency of the turbine.

In the above-described steam turbine casing position adjusting apparatus, it is more preferred that the sensor be provided inside the inner casing and measure an axial distance between an axiswise middle of the inner casing and a measurement surface of the rotor.

According to this steam turbine casing position adjusting apparatus, the axial distance between the axiswise middle of the inner casing and the measurement surface of the rotor is measured by the sensor.

Thus, it is possible to ignore (it is not necessary to consider) the influence of a thermal elongation of the inner casing, to more accurately measure the thermal elongation difference due to the relative thermal expansion of the turbine casing and the rotor, to reduce the clearance between the turbine casing and the rotor, and to improve the efficiency of the turbine.

In the above-described steam turbine casing position adjusting apparatus, it is more preferred that the sensor include a sensor that measures a relative distance of the inner casing in the axial direction with respect to the ground on which the outer casing is installed and a sensor that measures a relative distance of the rotor in the axial direction with respect to the ground; the calculator calculate, in addition to the thermal elongation difference of the rotor in the axial direction with respect to the inner casing and the angle of inclination of the rotor with respect to the inner casing, a thermal elongation difference of the inner casing in the axial direction with respect to the ground, an angle of inclination of the inner casing with respect to the ground, a thermal elongation difference of the rotor in the axial direction with respect to the ground, and an angle of inclination of the rotor with respect to the ground, based on data sent from the sensors; and the controller output a command signal for controlling the actuator such that the relative position relation between the inner casing and the rotor is not changed by canceling all of the thermal elongation differences and the angles of inclination calculated by the calculator.

According to this steam turbine casing position adjusting apparatus, inclination and a thermal elongation of the inner casing with respect to the ground due to the thermal expansion thereof and inclination and a thermal elongation of the rotor with respect to the ground due to the thermal expansion thereof are considered.

Thus, it is possible to more accurately measure the thermal elongation difference due to the relative thermal expansion of the turbine casing and the rotor, to reduce the clearance between the turbine casing and the rotor, and to improve the efficiency of the turbine.

In the above-described steam turbine casing position adjusting apparatus, it is more preferred that the sensors and the actuator be provided outside the outer casing.

According to this steam turbine casing position adjusting apparatus, the sensor and the actuator are provided outside the outer casing, so that they are not exposed to high-temperature steam.

Thus, it is possible to reduce the occurrence of thermal damage and failure of the sensor and the actuator, to lengthen the lives thereof, and to improve the reliability of the sensor and the actuator.

In the above-described steam turbine casing position adjusting apparatus, it is more preferred that the turbine casing be supported on a ground via a supporting unit that includes a radial-direction guide that permits a thermal elongation of the turbine casing in a radial direction due to thermal expansion thereof and an axial-direction guide that permits movement of the turbine casing in the axial direction.

According to this steam turbine casing position adjusting apparatus, a thermal elongation of the turbine casing in the radial direction due to thermal expansion thereof can be permitted (absorbed).

In the above-described steam turbine casing position adjusting apparatus, it is more preferred that the turbine casing and the actuator be coupled via a coupling unit that includes a horizontal-direction guide that permits a thermal elongation of the turbine casing in a horizontal direction due to thermal expansion thereof and a height-direction guide that permits a thermal elongation of the turbine casing in a height direction due to thermal expansion thereof.

According to this steam turbine casing position adjusting apparatus, a thermal elongation of the turbine casing in the horizontal direction due to thermal expansion thereof is permitted by the horizontal-direction guide, and a thermal elongation of the turbine casing in the height direction due to thermal expansion thereof is permitted by the height-direction guide.

Thus, it is possible to avoid a situation in which an excess load is applied to a joint part of the turbine casing and the actuator, preventing the joint part of the turbine casing and the actuator from being damaged.

In the above-described steam turbine casing position adjusting apparatus, it is more preferred that the inner casing be supported on the outer casing or on a ground on which the outer casing is fixed, via a supporting unit that includes a radial-direction guide that permits a thermal elongation of the inner casing in a radial direction due to thermal expansion thereof and an axial-direction guide that permits movement of the inner casing in the axial direction.

According to this steam turbine casing position adjusting apparatus, a thermal elongation of the inner casing in the radial direction due to thermal expansion thereof can be permitted (absorbed).

In the above-described steam turbine casing position adjusting apparatus, it is more preferred that the inner casing and the actuator be coupled via a coupling unit that includes a horizontal-direction guide that permits a thermal elongation of the inner casing in a horizontal direction due to thermal expansion thereof and a height-direction guide that permits a thermal elongation of the inner casing in a height direction due to thermal expansion thereof.

According to this steam turbine casing position adjusting apparatus, a thermal elongation of the inner casing in the horizontal direction due to thermal expansion thereof is permitted by the horizontal-direction guide, and a thermal elongation of the inner casing in the height direction due to thermal expansion thereof is permitted by the height-direction guide.

Thus, it is possible to avoid a situation in which an excess load is applied to a joint part of the inner casing and the actuator, preventing the joint part of the inner casing and the actuator from being damaged.

In the above-described steam turbine casing position adjusting apparatus, it is more preferred that the actuator be provided outside the outer casing.

According to this steam turbine casing position adjusting apparatus, the actuator is provided outside the outer casing, so that it is not exposed to high-temperature steam.

Thus, it is possible to reduce the occurrence of thermal damage and failure of the actuator, to lengthen the life thereof, and to improve the reliability of the actuator.

The present invention provides a steam turbine including one of the above-described steam turbine casing position adjusting apparatuses.

According to the steam turbine of the present invention, the steam turbine casing position adjusting apparatus, which reduces the clearance between the turbine casing and the rotor, is provided; therefore, the efficiency of the turbine can be improved.

Advantageous Effects or Invention

According to the steam turbine casing position adjusting apparatus of the present invention, an advantageous effect is afforded in that it is possible to finely control the rotation (yawing) of the turbine casing and to employ a compact actuator.

Furthermore, an advantageous effect is afforded in that it is possible to reduce the clearance between the turbine casing and the rotor and to improve the efficiency of the turbine.

Furthermore, an advantageous effect is afforded in that it is possible to permit (absorb) a thermal elongation of the turbine casing (for example, inner casing) in the radial direction due to thermal expansion thereof.

DESCRIPTION OF EMBODIMENTS

First Embodiment

Figure 4:
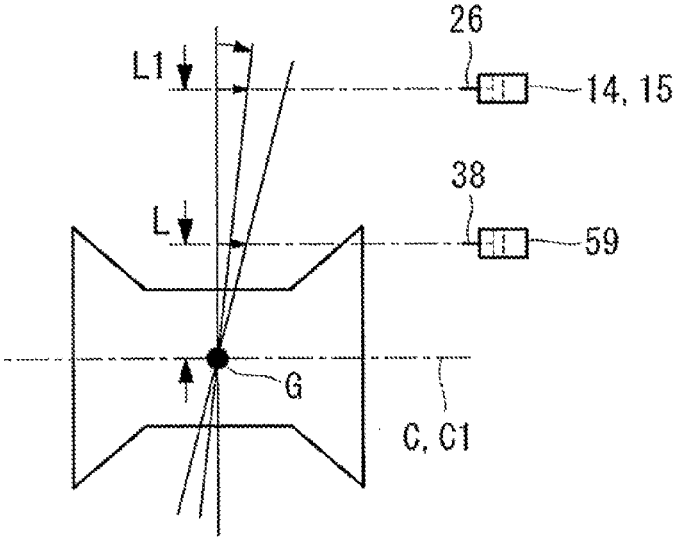
FIG. 4 is a plan view for explaining advantageous effects of the steam turbine casing position adjusting apparatus according to the present invention.

A steam turbine casing position adjusting apparatus according to a first embodiment of the present invention will be described below with reference to FIG. 1 and FIG. 4.

Figure 1:
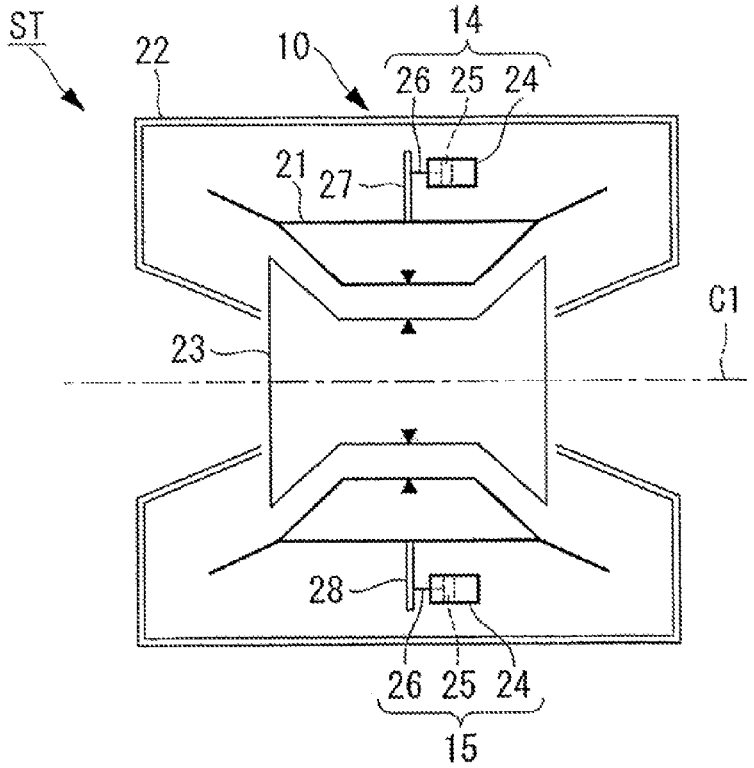
FIG. 1 is a plan view showing, in outline, the structure of a steam turbine casing position adjusting apparatus according to a first embodiment of the present invention.

FIG. 1 is a plan view showing, in outline, the structure of the steam turbine casing position adjusting apparatus according to this embodiment. FIG. 4 is a view for explaining advantageous effects of the steam turbine casing position adjusting apparatus according to the present invention.

As shown in FIG. 1, a steam turbine casing position adjusting apparatus 10 according to this embodiment includes a (first) actuator 14 and a (second) actuator 15.

The actuators 14 and 15 are fixed to an outer casing 22 that is provided (disposed) so as to surround the circumference (outer side) of an inner casing 21 (or fixed to grounds (not shown) on which the outer casing 22 is installed), and move the inner casing 21 in the axial direction with respect to the outer casing 22 and a rotor 23. The actuators 14 and 15 each include a cylinder 24 that extends in the axial direction, a piston 25 that reciprocates in the axial direction, and a rod 26 that is fixed to one end surface of the piston 25 and that advances and recedes in the axial direction.

An arm 27 that is fixed to a portion of the outer peripheral surface (outer surface) of the inner casing 21 located at the axiswise center of the inner casing 21 and that extends toward one side of the inner casing 21 (upward in FIG. 1) is connected to the distal end of the rod 26 of the actuator 14. An arm 28 that is fixed to a portion of the outer peripheral surface (outer surface) of the inner casing 21 located at the axiswise center of the inner casing 21 and that extends toward the other side of the inner casing 21 (downward in FIG. 1) is connected to the distal end of the rod 26 of the actuator 15.

Note that the arm 27 and the arm 28 are provided in a horizontal plane that includes a central line C1 extending in the axial direction of the inner casing 21, on opposite sides with the central axis C1 therebetween (at positions 180 degrees away from each other in the circumferential direction).

Furthermore, the actuator 14 and the actuator 15 are provided in a horizontal plane that includes the central line C1 extending in the axial direction of the outer casing 22, on opposite sides with the central axis C1 therebetween (at positions 180 degrees away from each other in the circumferential direction).

A side inlet tube (not shown) through which steam is supplied to the inside of the outer casing 22 is connected at the axiswise center (portion) of the outer casing 22, and the steam supplied through the side inlet tube is supplied to a steam inlet port of a steam turbine ST and then flows symmetrically in both axial directions (leftward and rightward in FIG. 1).

According to the steam turbine casing position adjusting apparatus 10 of this embodiment, the distal end of the rod 26 of the actuator 14 is connected to the arm 27 that is fixed to a portion of the outer peripheral surface of the inner casing 21 located at the axiswise center of the inner casing 21 and that extends toward one side of the inner casing 21. The distal end of the rod 26 of the actuator 15 is connected to the arm 28 that is fixed to a portion of the outer peripheral surface of the inner casing 21 located at the axiswise center of the inner casing 21 and that extends toward the other side of the inner casing 21. Specifically, as shown in FIG. 4, the actuators 14 and 15 of this embodiment are each provided at a position away from the central line C1, which extends in the axial direction of the inner casing 21, in other words, at a position where the length of a perpendicular (the distance) from the distal end of the rod 26 of the actuator 14 or 15 to the central line C1 becomes L1 (>L). Thus, even if the rod 26 is made to advance and recede by a large amount, rotation (yawing) of the inner casing 21 about a center of gravity G is suppressed.

Thus, the actuators 14 and 15 do not require extremely high resolution in order to suppress the rotation (yawing) of the inner casing 21 to a permitted value or lower, thus eliminating the need to adopt expensive actuators, as the actuators 14 and 15, which avoids high cost (achieves a reduction in cost).

Figure 5:
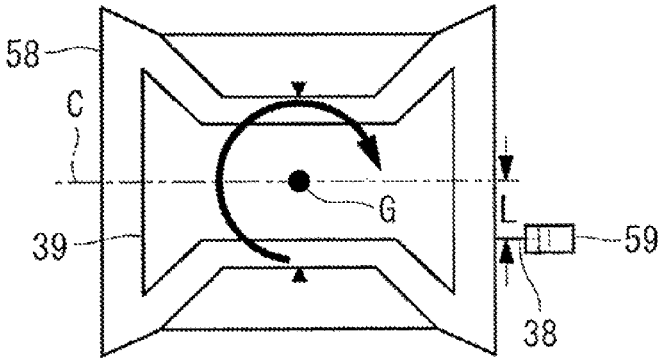
FIG. 5 is a plan view for explaining a problem in conventional technologies.

Furthermore, according to the steam turbine casing position adjusting apparatus 10 of the present invention, because the actuator 14 is not disposed on an end surface of a turbine casing 58 shown in FIG. 5, for example, it is possible to avoid an increase in the size of the steam turbine ST in the axial direction. In particular, in a power plant where a plurality of steam turbines ST are disposed in the axial direction of the steam turbines ST, an increase in the length of the whole plant in the axial direction can be avoided.

Furthermore, according to the steam turbine casing position adjusting apparatus 10 of this embodiment, the distal end of the rod 26 of the actuator 14 is connected to the arm 27 that is fixed to a portion of the outer peripheral surface of the inner casing 21 located at the axiswise center of the inner casing 21 and that extends toward one side of the inner casing 21, and the distal end of the rod 26 of the actuator 15 is connected to the arm 28 that is fixed to a portion of the outer peripheral surface of the inner casing 21 located at the axiswise center of the inner casing 21 and that extends toward the other side of the inner casing 21. Specifically, as shown in FIG. 4, the actuators 14 and 15 of this embodiment are provided at positions where they are not affected by a thermal elongation of the inner casing 21 in the axial direction due to thermal expansion thereof, in other words, at positions where the influence of a thermal elongation of the inner casing 21 in the axial direction due to thermal expansion thereof can be ignored (need not be considered).

Thus, the actuators 14 and 15 do not require a function for making their rods 26 recede by a large amount in the axial direction to absorb a thermal elongation of the inner casing 21 in the axial direction due to thermal expansion thereof, thus eliminating the need to adopt large-scale actuators with a large stroke, as the actuators 14 and 15, which avoids an increase in size in the axial direction.

Furthermore, according to the steam turbine casing position adjusting apparatus 10 of this embodiment, the actuators 14 and 15 and the arms 27 and 28 are not disposed in the flow path of steam flowing in the inner casing 21 symmetrically in both axial directions.

Thus, it is possible to avoid an increase in (exhaust) resistance in the steam flow path and to avoid a decrease in the efficiency of the steam turbine ST.

Furthermore, according to the steam turbine casing position adjusting apparatus 10 of this embodiment, the actuator 14 and the actuator 15 are disposed in a space formed between the outer peripheral surface of the inner casing 21 and the inner peripheral surface (inner surface) of the outer casing 22, specifically, in a dead space formed between a lateral center portion of the inner casing and a lateral center portion of the outer casing, in other words, radially inside the outer peripheral surface of the outer casing 22.

Thus, it is possible to suppress an increase in the size of the steam turbine in the radial direction, compared with a case where the actuator 14 and the actuator 15 are simply disposed outside the outer casing 22.

Second Embodiment

A steam turbine casing position adjusting apparatus according to a second embodiment of the present invention will be described below with reference to FIGS. 2 to 4.

Figure 2:
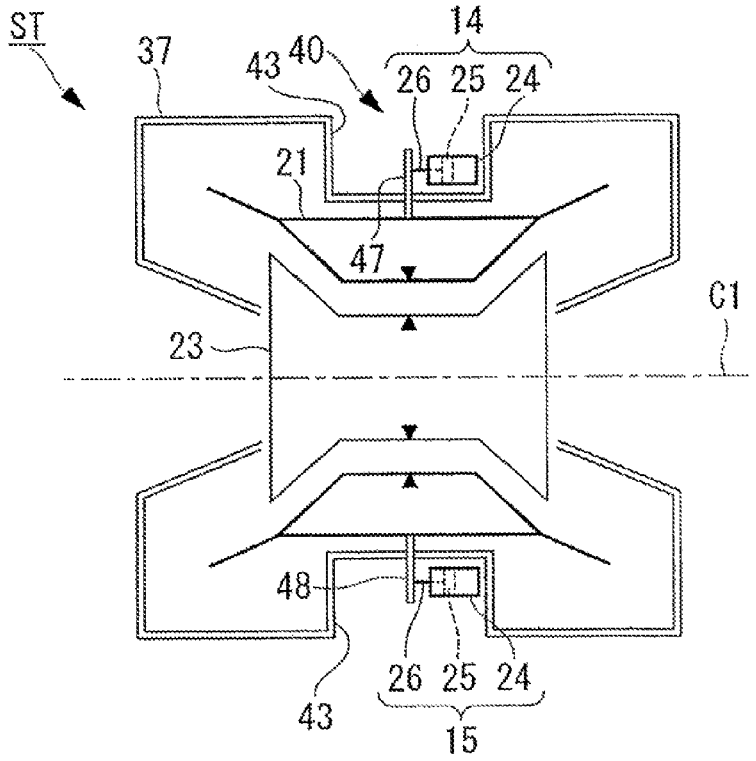
FIG. 2 is a plan view showing, in outline, the structure of a steam turbine casing position adjusting apparatus according to a second embodiment of the present invention.

FIG. 2 is a plan view showing, in outline, the structure of the steam turbine casing position adjusting apparatus according to this embodiment. FIG. 3 is a view showing, in enlarged form, a main portion shown in FIG. 2.

As shown in FIG. 2, a steam turbine casing position adjusting apparatus 40 according to this embodiment differs from that of the above-described first embodiment in that the (first) actuator 14 and the (second) actuator 15, described in the first embodiment, are provided (installed) outside (at the outsides of) the inner casing 21 and the outer casing 37.

As shown in FIG. 2, the steam turbine casing position adjusting apparatus 40 according to this embodiment includes the (first) actuator 14 and the (second) actuator 15.

The actuators 14 and 15 are fixed outside (at the outsides of) the outer casing 37 that is provided (disposed) so as to surround the circumference (outer side) of the inner casing 21 (or grounds (not shown) on which the outer casing 37 is installed), and move the inner casing 21 in the axial direction with respect to the outer casing 37 and the rotor 23. The actuators 14 and 15 each include the cylinder 24, which extends in the axial direction, the piston 25, which reciprocates in the axial direction, and the rod 26, which is fixed to one end surface of the piston 25 and which advances and recedes in the axial direction.

An arm 47 that is fixed to a portion of the outer peripheral surface (outer surface) of the inner casing 21 located at the axiswise center of the inner casing 21, that penetrates the outer peripheral surface (outer surface) of the outer casing 37, and that extends toward one side of the inner casing 21 (upward in FIG. 2) is connected to the distal end of the rod 26 of the actuator 14. An arm 48 that is fixed to a portion of the outer peripheral surface (outer surface) of the inner casing 21 located at the axiswise center of the inner casing 21, that penetrates the outer peripheral surface (outer surface) of the outer casing 37, and that extends toward the other side of the inner casing 21 (downward in FIG. 2) is connected to the distal end of the rod 26 of the actuator 15.

Note that the arm 47 and the arm 48 are provided in a horizontal plane that includes the central line C1 extending in the axial direction of the inner casing 21, on opposite sides with the central axis C1 therebetween (at positions 180 degrees away from each other in the circumferential direction).

Furthermore, the actuator 14 and the actuator 15 are provided in a horizontal plane that includes the central line C1 extending in the axial direction of the outer casing 37, on opposite sides with the central axis C1 therebetween (at positions 180 degrees away from each other in the circumferential direction).

Furthermore, the actuator 14 and the actuator 15 are disposed in a recess (constricted portion) 43 that is provided in the circumferential direction at the axiswise center portion of the outer casing 37.

Figure 3:
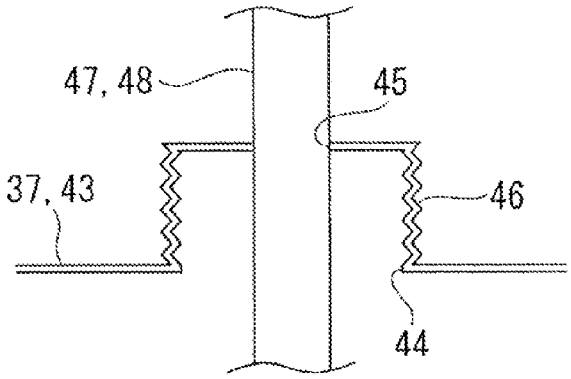
FIG. 3 is a view showing, in enlarged form, a main portion shown in FIG. 2.

Furthermore, as shown in FIG. 3, a bellows 46 having a through-hole 45 into which the arm 47 or 48 is inserted is mounted inside a through-hole 44 that is provided in the outer casing 37 forming the recess 43 and into which the arm 47 or 48 is inserted. Then, the space between the through-hole 44 and the bellows 46 and the space between the through-hole 45 and the arm 47 or 48 are blocked through welding so as to prevent steam in the outer casing 37 from leaking to the outside of the outer casing 37.

A side inlet tube (not shown) through which steam is supplied to the inside of the outer casing 37 is connected at the axiswise center (portion) of the outer casing 37, and the steam supplied through the side inlet tube is supplied to a steam inlet port of the steam turbine ST and then flows symmetrically in both axial directions (leftward and rightward in FIG. 2).

According to the steam turbine casing position adjusting apparatus 40 of this embodiment, the distal end of the rod 26 of the actuator 14 is connected to the arm 47, which is fixed to a portion of the outer peripheral surface of the inner casing 21 located at the axiswise center of the inner casing 21 and which extends toward one side of the inner casing 21, and the distal end of the rod 26 of the actuator 15 is connected to the arm 48, which is fixed to a portion of the outer peripheral surface of the inner casing 21 located at the axiswise center of the inner casing 21 and which extends toward the other side of the inner casing 21. Specifically, as shown in FIG. 4, the actuators 14 and 15 according to this embodiment are each provided at a position away from the central line C1, which extends in the axial direction of the inner casing 21, in other words, at a position where the length of a perpendicular (the distance) from the distal end of the rod 26, which constitutes the actuator 14 or 15, to the central line C1 becomes L1 (>L). Thus, even if the rod 26 is made to advance and recede by a large amount, rotation (yawing) of the inner casing 21 about the center of gravity G is suppressed.

Thus, the actuators 14 and 15 do not require extremely high resolution in order to suppress the rotation (yawing) of the inner casing 21 to a permitted value or lower, thus eliminating the need to adopt expensive actuators, as the actuators 14 and 15, which avoids high cost (achieves a reduction in cost).

Furthermore, according to the steam turbine casing position adjusting apparatus 40 of the present invention, because the actuator 14 is not disposed on an end surface of the turbine casing 58 shown in FIG. 5, for example, it is possible to avoid an increase in the size of the steam turbine ST in the axial direction. In particular, in a power plant where a plurality of steam turbines ST are disposed in the axial direction of the steam turbines ST, an increase in the length of the whole plant in the axial direction can be avoided.

Furthermore, according to the steam turbine casing position adjusting apparatus 40 of this embodiment, the distal end of the rod 26 of the actuator 14 is connected to the arm 47, which is fixed to a portion of the outer peripheral surface of the inner casing 21 located at the axiswise center of the inner casing 21 and which extends toward one side of the inner casing 21, and the distal end of the rod 26 of the actuator 15 is connected to the arm 48, which is fixed to a portion of the outer peripheral surface of the inner casing 21 located at the axiswise center of the inner casing 21 and which extends toward the other side of the inner casing 21. Specifically, as shown in FIG. 4, the actuators 14 and 15 of this embodiment are provided at positions where they are not affected by a thermal elongation of the inner casing 21 in the axial direction due to thermal expansion thereof, in other words, at positions where the influence of a thermal elongation of the inner casing 21 in the axial direction due to thermal expansion thereof can be ignored (need not be considered).

Thus, the actuators 14 and 15 do not requite a function for making their rods 26 recede by a large amount in the axial direction to absorb a thermal elongation of the inner casing 21 in the axial direction due to thermal expansion thereof, thus eliminating the need to adopt large-scale actuators with a large stroke, as the actuators 14 and 15, which avoids an increase in size in the axial direction.

Furthermore, according to the steam turbine casing position adjusting apparatus 40 of this embodiment, the actuators 14 and 15 and the arms 47 and 48 are not disposed in the flow path of steam flowing in the inner casing 21 symmetrically in both axial directions.

Thus, it is possible to avoid an increase in (exhaust) resistance in the steam flow path and to avoid a decrease in the efficiency of the steam turbine ST.

Furthermore, according to the steam turbine casing position adjusting apparatus 40 of this embodiment, the actuators 14 and 15 are provided outside the outer casing 37, so that they are not exposed to high-temperature steam.

Thus, it is possible to reduce the occurrence of thermal damage and failure of the actuators 14 and 15, to lengthen the lives thereof, and to improve the reliability of the actuators 14 and 15.

Furthermore, according to the steam turbine casing position adjusting apparatus 40 of this embodiment, the actuator 14 and the actuator 15 are disposed in the recess (constricted portion) 43, which is provided at the axiswise center portion of the outer casing 37, specifically, in a dead space formed at a lateral center portion of the outer casing 37, in other words, radially inside the outer peripheral surface of the outer casing 37.

Thus, it is possible to suppress an increase in the size of the steam turbine ST in the radial direction, compared with a case where the actuator 14 and the actuator 15 are disposed outside the outer casing 37 that is not provided with the recess 43.

Note that the present invention is not limited to the above-described embodiments, and changes in shape and modifications can be appropriately made as needed.

For example, the arms 27, 28, 47, and 48 need not be fixed to the outer peripheral surface of the inner casing 21 so as to extend outward (toward one side or the other side) from the axiswise center of the inner casing 21; they may be provided at positions shifted, in the axial direction, from the axiswise center of the inner casing 21.

Furthermore, in the above-described embodiments, a description has been given of an example steam turbine that has both the outer casing and the inner casing serving as turbine casings; however, the steam turbine casing position adjusting apparatus according to the present invention can be applied to a steam turbine that does not have the inner casing inside the outer casing does not have the outer casing outside the inner casing), i.e., a steam turbine that has only one casing serving as a turbine casing.

Third Embodiment

A steam turbine casing position adjusting apparatus according to a third embodiment of the present invention will be described below with reference to FIGS. 6 to 12.

Figure 6:
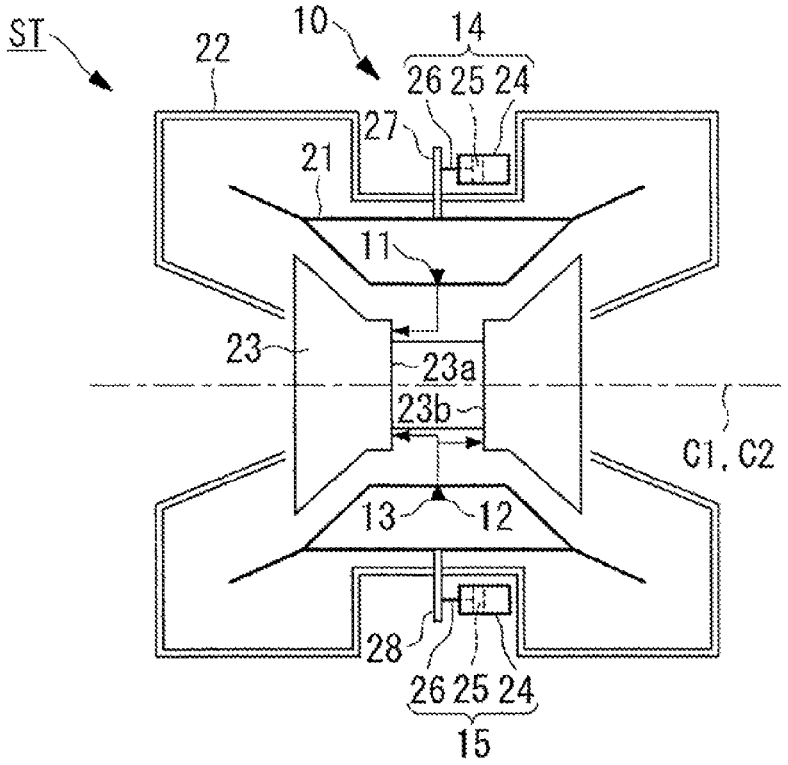
FIG. 6 is a plan view showing, in outline, the structure of a steam turbine casing position adjusting apparatus according to a third embodiment of the present invention.
Figure 7:
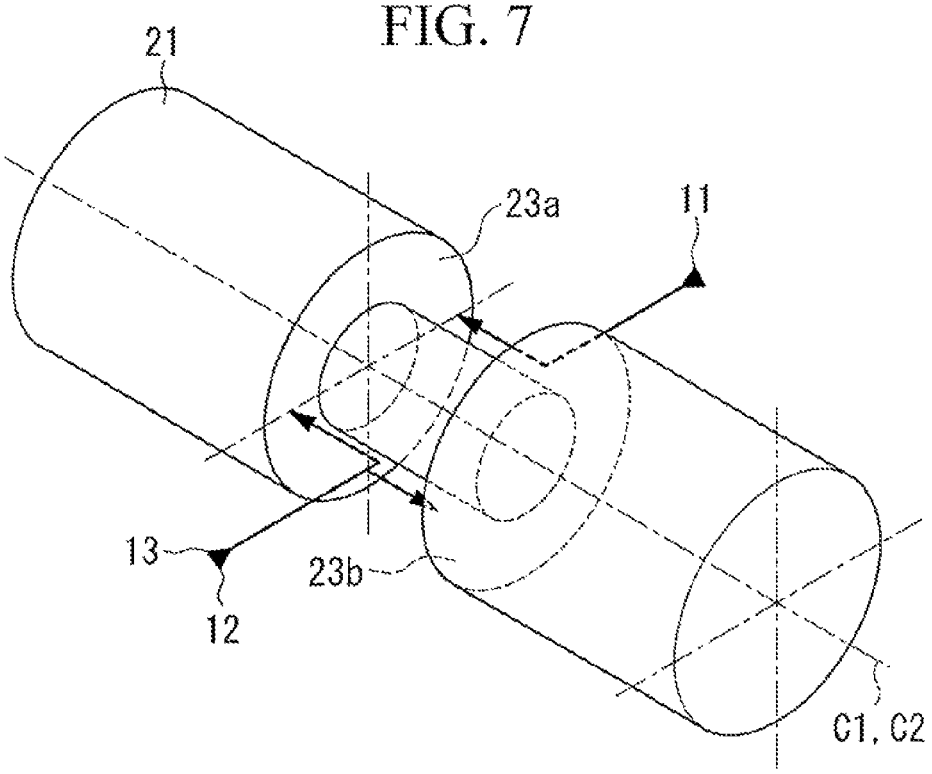
FIG. 7 is a perspective view showing, in enlarged form, a main portion shown in FIG. 6.
Figure 8:
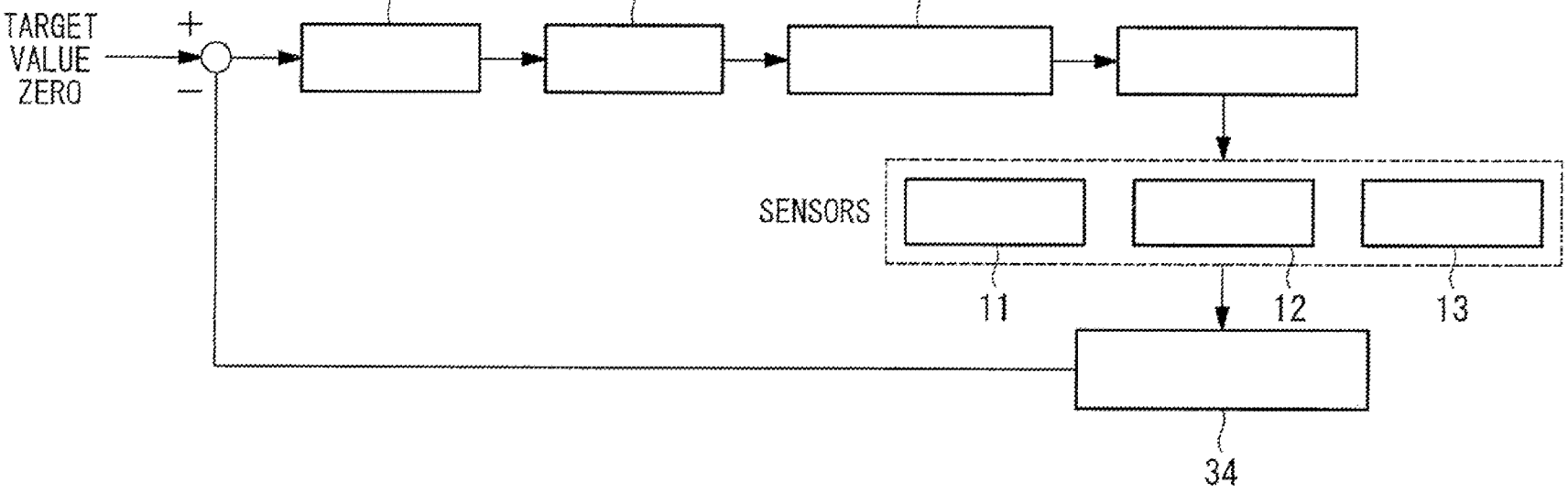
FIG. 8 is a block diagram of the steam turbine casing position adjusting apparatus according to the third embodiment of the present invention.
Figure 9:
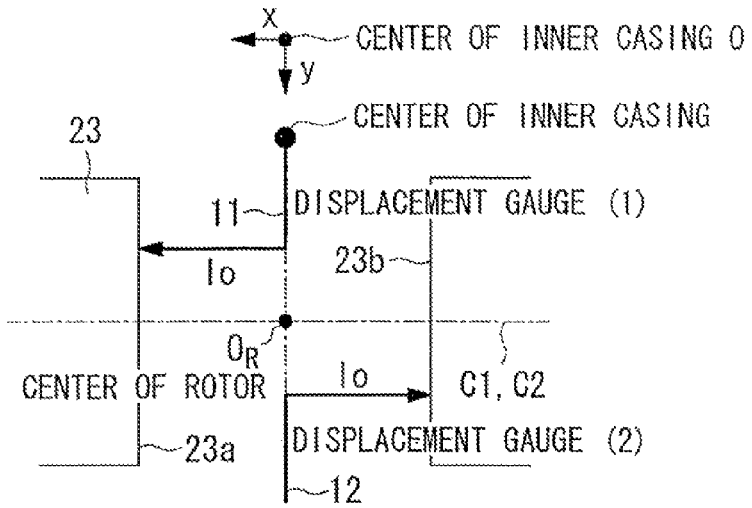
FIG. 9 is a view for explaining an equation for calculating a thermal elongation difference $\delta$.
Figure 10:
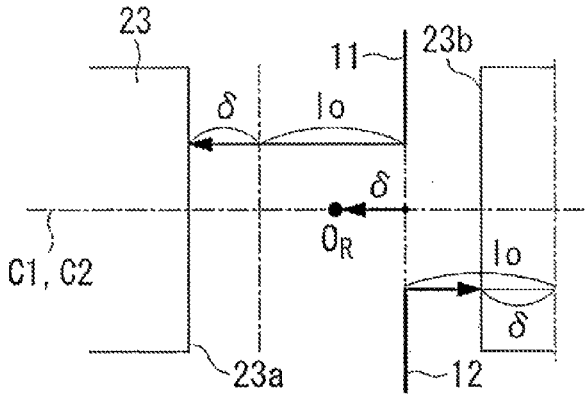
FIG. 10 is a view for explaining the equation for calculating the thermal elongation difference $\delta$.
Figure 11:
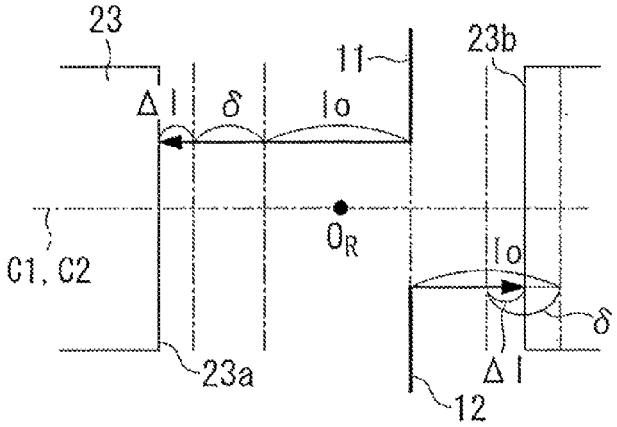
FIG. 11 is a view for explaining the equation for calculating the thermal elongation difference $\delta$.
Figure 12:
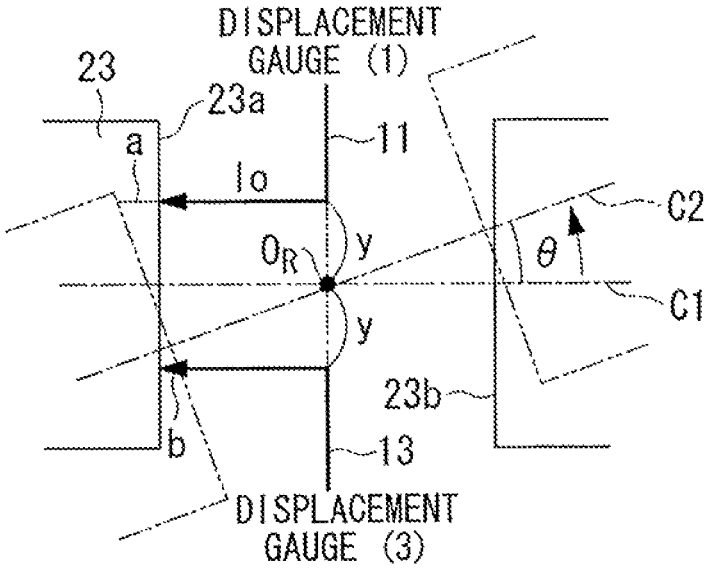
FIG. 12 is a view for explaining an equation for calculating an angle of inclination $\theta$.

FIG. 6 is a plan view showing, in outline, the structure of the steam turbine casing position adjusting apparatus according to this embodiment. FIG. 7 is a perspective view showing, in enlarged form, a main portion shown in FIG. 6. FIG. 8 is a block diagram of the steam turbine casing position adjusting apparatus according to this embodiment. FIGS. 9 to 11 are views for explaining an equation for calculating a thermal elongation difference δ. FIG. 12 is a view for explaining an equation for calculating an angle of inclination θ.

As shown in FIG. 6 or FIG. 7, the steam turbine casing position adjusting apparatus 10 according to this embodiment includes a (first) displacement gauge 11, a (second) displacement gauge 12, a (third) displacement gauge 13, the (first) actuator 14, and the (second) actuator 15.

The displacement gauge 11 is a sensor (for example, eddy-current gap sensor) that is provided (installed) inside (at the inside of) the inner casing 21 at a position located on one side of the rotor 23 (upward in FIG. 6) and that measures the axial distance (gap) between the middle (center) of the inner casing 21 in the axial direction (horizontal direction in FIG. 6) and an end surface 23*a* of the rotor 23 located inside (at the inside of) the inner casing 21.

The displacement gauge 12 is a sensor (for example, eddy-current gap sensor) that is provided (installed) inside (at the inside of) the inner casing 21 at a position located on the other side of the rotor 23 (downward in FIG. 6) and that measures the axial distance (gap) between the middle (center) of the inner casing 21 in the axial direction (horizontal direction in FIG. 6) and an end surface (end surface facing the end surface 23*a*) 23*b* of the rotor 23 located inside (at the inside of) the inner casing 21.

The displacement gauge 13 is a sensor (for example, eddy-current gap sensor) that is provided (installed) inside (at the inside of) the inner casing 21 and that measures the axial distance (gap) between the middle (center) of the inner casing 21 in the axial direction (horizontal direction in FIG. 6) and the end surface 23*a* of the rotor 23.

Note that the displacement gauge 11 and the displacement gauge 13 are provided in a horizontal plane that includes the central line C1 extending in the axial direction of the inner casing 21, on opposite sides with the central axis C1 therebetween (at positions 180 degrees away from each other in the circumferential direction).

Furthermore, the displacement gauge 12 is provided in a horizontal plane that includes the central line C1 extending in the axial direction of the inner casing 21, in the vicinity of the displacement gauge 13.

The actuators 14 and 15 are fixed outside (at the outside of) the outer casing 22 that is provided (disposed) so as to surround the circumference (outer side) of the inner casing 21, and move the inner casing 21 in the axial direction with respect to the outer casing 22 and the rotor 23. The actuators 14 and 15 each include the cylinder 24, which extends in the axial direction, the piston 25, which reciprocates in the axial direction, and the rod 26, which is fixed to one end surface of the piston 25 and which advances and recedes in the axial direction.

The arm 27 that is fixed to the outer peripheral surface (outer surface) of the inner casing 21 and that extends toward one side of the inner casing 21 (upward in FIG. 6) is connected to the distal end of the rod 26 of the actuator 14. The arm 28 that is fixed to the outer peripheral surface (outer surface) of the inner casing 21 and that extends toward the other side of the inner casing 21 (downward in FIG. 6) is connected to the distal end of the rod 26 of the actuator 15.

Note that the arm 27 and the arm 28 are provided in a horizontal plane that includes the central line C1 extending in the axial direction of the inner casing 21, on opposite sides with the central axis C1 therebetween (at positions 180 degrees away from each other in the circumferential direction).

Furthermore, the actuator 14 and the actuator 15 are provided in a horizontal, plane that includes the central line C1 extending in the axial direction of the outer casing 22, on opposite sides with the central axis C1 therebetween (at positions 180 degrees away from each other in the circumferential direction).

The side inlet tube (not shown) through which steam is supplied to the inside of the outer casing 22 is connected at the axiswise center (portion) of the outer casing 22, and the steam supplied through the side inlet tube is supplied to the steam inlet port of the steam turbine ST and then flows symmetrically in both axial directions (leftward and rightward in FIG. 6).

As shown in FIG. 8, pieces of data (measurement values) measured by the displacement gauges 11, 12, and 13 are sent to a calculator 34, and the calculator 34 calculates a thermal elongation difference δ and an angle of inclination θ based on the data sent from the displacement gauges 11, 12, and 13.

The thermal elongation difference δ and the angle of inclination θ calculated by the calculator 34 are sent to a controller 35, and the controller 35 calculates a command value (actuation value) for making the rods 26 of the actuators 14 and 15 advance and recede, so as to cancel out (offset) the thermal elongation difference δ and the angle of inclination θ calculated by the calculator 34, so that the relative position of the inner casing 21 and the rotor 23 does not change (so that the relative position thereof is stabilized).

The command value calculated by the controller 35 is output as a command signal (actuation signal) for making the rods 26 of the actuators 14 and 15 advance and recede, is amplified by an amplifier 36, and is sent to the actuators 14 and 15. Then, the rods 26 of the actuators 14 and 15 are made to advance and recede based on the command signal, thereby moving and inclining the inner casing 21 in the axial direction and maintaining the relative position of the inner casing 21 and the rotor 23 unchanged.

Here, a method of calculating the thermal elongation difference δ will be described with reference to FIGS. 9 to 11.

As described above, the displacement gauge 11 is a sensor for measuring an axial distance $X_1$ between the middle (center) of the inner casing 21 (see FIG. 6) in the axial direction (horizontal direction in FIG. 9) and the end surface 23*a* of the rotor 23, and the displacement gauge 12 is a sensor for measuring an axial distance $X_2$ between the axiswise middle of the inner casing 21 and the end surface 23*b* of the rotor 23. As shown in FIG. 9, in a cold state where the steam turbine ST is shut down (in a state in which the thermal elongation difference δ and/or the angle of inclination θ has not been produced), the displacement gauges 11 and 12 are installed (initially set) such that pieces of data (measurement values) measured by the displacement gauges 11 and 12 become equal ($l_O$ in this embodiment), specifically, such that the axial distance $X_1$ between the axiswise middle of the inner casing 21 and the end surface 23*a* of the rotor 23 becomes $+l_O$, and the axial distance $X_2$ between the axiswise middle of the inner casing 21 and the end surface 23*b* of the rotor 23 becomes $-l_O$.

Note that, in the cold state where the steam turbine ST is shut down, the center $O_R$ of the rotor 23 is located in a vertical plane that includes the axiswise middle of the inner casing 21.

Next, when another steam turbine (not shown) that is different from the steam turbine ST is disposed between the steam turbine ST and a thrust bearing (not shown) (when the steam turbine ST is, for example, a low-pressure turbine farthest from the thrust bearing), as shown in FIG. 10, the influence of a thermal elongation of a rotor (not shown) constituting the steam turbine disposed between the steam turbine ST and the thrust bearing appears as the thermal elongation difference δ. At this time, the axial distance $X_1$ between the axiswise middle of the inner casing 21 and the end surface 23*a* of the rotor 23 is $l_O+\delta$, and the axial distance $X_2$ between the axiswise middle of the inner casing 21 and the end surface 23*b* of the rotor 23 is $-l_O+\delta$. From the equations $X_1=l_O+\delta$ and $X_2=-l_O+\delta$, an equation for the thermal elongation difference $\delta=(X_1+X_2)/2$ can be derived. Specifically, the thermal elongation difference δ can be easily calculated by calculating the sum of the axial distance $X_1$ between the axiswise middle of the inner casing 21 and the end surface 23*a* of the rotor 23, which is measured by the displacement gauge 11, and the axial distance $X_2$ between the axiswise middle of the inner casing 21 and the end surface 23*b* of the rotor 23, which is measured by the displacement gauge 12, and by dividing the sum by 2.

As shown in FIG. 11, when a thermal elongation difference Δl inherent to the rotor 23 constituting the steam turbine ST is considered, the axial distance $X_1$ between the axiswise middle of the inner casing 21 and the end surface 23*a* of the rotor 23 is $l_O+\delta+\Delta l$, and the axial distance $X_2$ between the axiswise middle of the inner casing 21 and the end surface 23*b* of the rotor 23 is $-l_O+\delta-\Delta l$. From the equations $X_1=l_O+\delta+\Delta l$ and $X_2=-l_O+\delta-\Delta l$, an equation for the thermal elongation difference $\delta=(X_1+X_2)/2$ can be derived. Specifically, the thermal elongation difference δ can be easily calculated by calculating the sum of the axial distance $X_1$ between the axiswise middle of the inner casing 21 and the end surface 23*a* of the rotor 23, which is measured by the displacement gauge 11, and the axial distance $X_2$ between the axiswise middle of the inner casing 21 and the end surface 23*b* of the rotor 23, which is measured by the displacement gauge 12, and by dividing the sum by 2. In this way, the thermal elongation difference δ can be easily calculated by using the equation $(X_1+X_2)/2$, independently of whether the thermal elongation difference Δl inherent to the rotor 23 constituting the steam turbine ST is considered or not.

Note that, since the displacement gauge 11 is a sensor for measuring the axial distance between the axiswise middle of the inner casing 21 and the end surface 23*a* of the rotor 23, and the displacement gauge 12 is a tensor for measuring the axial distance between the axiswise middle of the inner casing 21 and the end surface 23*b* of the rotor 23, the influence of a thermal elongation of the inner casing 21 can be ignored (need not be considered).

Next, a method of calculating the angle of inclination θ (angle (acute angle) formed by the central line C1, which extends in the axial direction of the inner casing 21, and a central line C2 extending in the axial direction of the rotor 23) will be described with reference to FIG. 12.

As described above, the displacement gauges 11 and 13 are sensors for respectively measuring the axial distances $X_1$ and $X_3$ between the middle (center) of the inner casing 21 (see FIG. 6) in the axial direction (horizontal direction in FIG. 9) and the end surface 23*a* of the rotor 23. As indicated by the solid lines in FIG. 12, in the cold state where the steam turbine ST is shut down (in the state in which the thermal elongation difference δ and/or the angle of inclination θ has not been produced), the displacement gauges 11 and 13 are installed (initially set) such that pieces of data measurement values) measured by the displacement gauges 11 and 13 become equal ($l_O$ in this embodiment), specifically, such that the axial distance $X_1$ between the axiswise middle of the inner casing 21 and the end surface 23*a* of the rotor 23 becomes $+l_O$, and the axial distance $X_3$ between the axiswise middle of the inner casing 21 and the end surface 23*a* of the rotor 23 becomes $+l_O$.

Next, as indicated by the two-dot chain lines in FIG. 12, if the rotor 23 constituting the steam turbine ST is inclined with respect to the inner casing 21 by the angle of inclination θ, the axial distance $X_1$ between the axiswise middle of the inner casing 21 and the end surface 23*a* of the rotor 23 is $l_O+a$, and the axial distance $X_3$ between the axiswise middle of the inner casing 21 and the end surface 23*a* of the rotor 23 is $l_O-b$. From the equations $X_1=l_O+a$ and $X_3=l_O-b$, an equation $X_1-X_3=a+b$ can be derived. The angle of inclination θ can be easily calculated by using an equation for the angle of inclination $\theta=\tan^{-1}((a+b)/2y)$, specifically, $\theta=\tan^{-1}((X_1-X_2)/2y)$. Then, the rods 26 of the actuators 14 and 15 are made to advance and recede such that the calculated thermal elongation difference δ and angle of inclination θ are cancelled out (offset: set to zero); thus, even in a hot state where the steam turbine ST is operated (in the state in which the thermal elongation difference δ and/or the angle of inclination θ has been produced), the center $O_R$ of the rotor 23 is located in a vertical plane that includes the axiswise middle of the inner casing 21, and the relative position of the inner casing 21 and the rotor 23 is maintained unchanged (so as to be stabilized).

Note that y is the distance in the y direction (see FIG. 9) from the center $O_R$ of the rotor 23 to the center (base point) of a measuring part (sensor part) of each of the displacement gauges 11 and 13.

According to the steam turbine casing position adjusting apparatus 10 of this embodiment, the actuators 14 and 15 are controlled such that the thermal elongation difference δ of the rotor 23 in the axial direction with respect to the inner casing 21 and/or the angle of inclination θ of the rotor 23 with respect to the inner casing 21 are cancelled out (offset: set to zero); thus, even in the hot state where the steam turbine ST is operated (in the state in which the thermal elongation difference δ and/or the angle of inclination θ has been produced), the relative position of the inner casing 21 and the rotor 23 is maintained unchanged (so as to be stabilized).

Thus, it is possible to reduce the clearance between the inner casing (turbine casing) 21 and the rotor 23 and to improve the efficiency of the turbine.

Furthermore, according to the steam turbine casing position adjusting apparatus 10 of this embodiment, the axial distances from the axiswise middle of the inner casing 21 to the end surface (measurement surface) 23*a* and the end surface (measurement surface) 23*b* of the rotor 23 are measured by the displacement gauges 11, 12, and 13.

Thus, it is possible to ignore (it is not necessary to consider) the influence of a thermal elongation of the inner casing 21, to more accurately measure the thermal elongation difference δ due to the relative thermal expansion of the inner casing (turbine casing) 21 and the rotor 23, to reduce the clearance between the inner casing 21 and the rotor 23, and to improve the efficiency of the turbine.

Fourth Embodiment

A steam turbine casing position adjusting apparatus according to a fourth embodiment of the present invention will be described below with reference to FIGS. 13 to 20.

Figure 13:
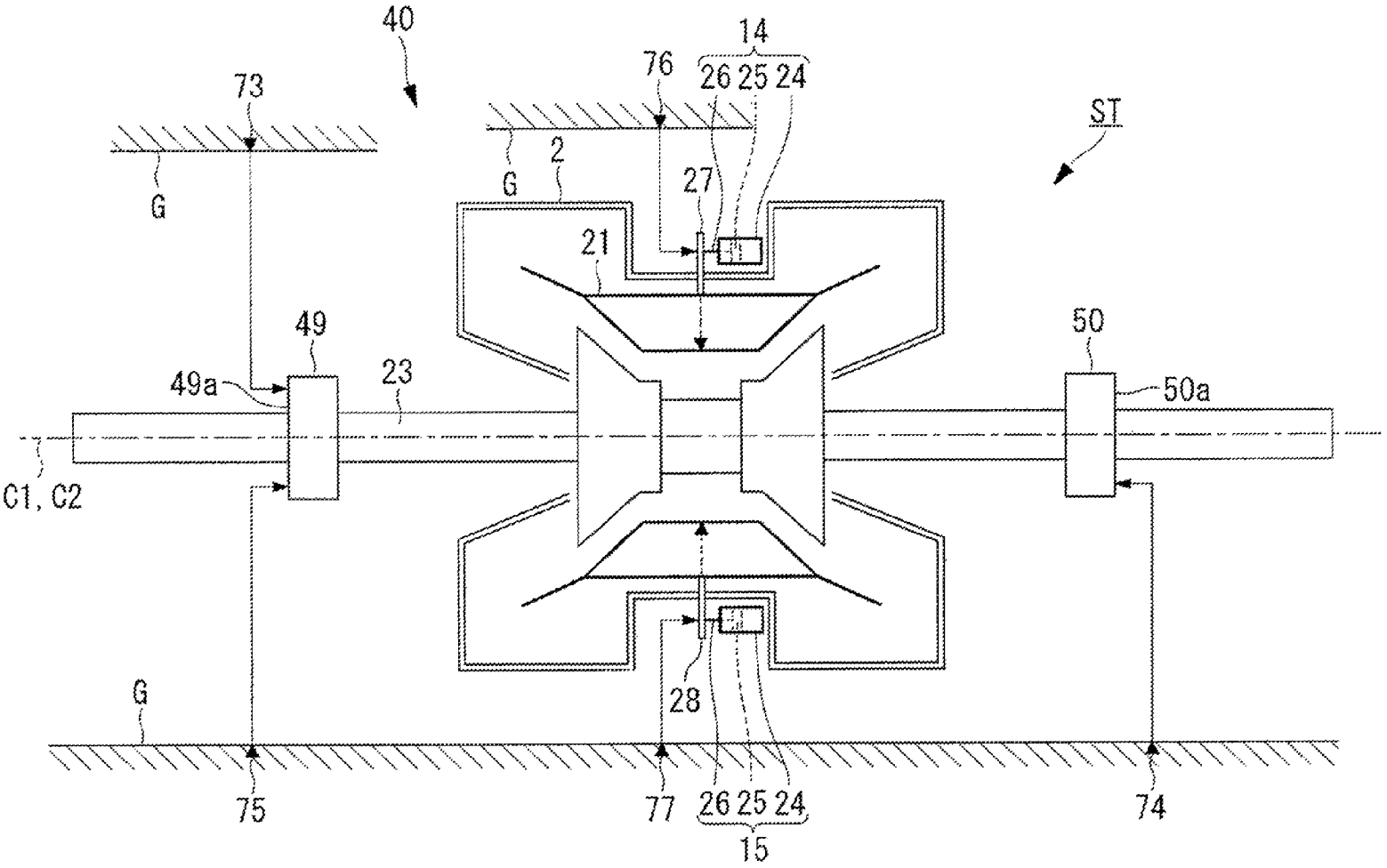
FIG. 13 is a plan view showing, in outline, the structure of a steam turbine casing position adjusting apparatus according to a fourth embodiment of the present invention.
Figure 14:
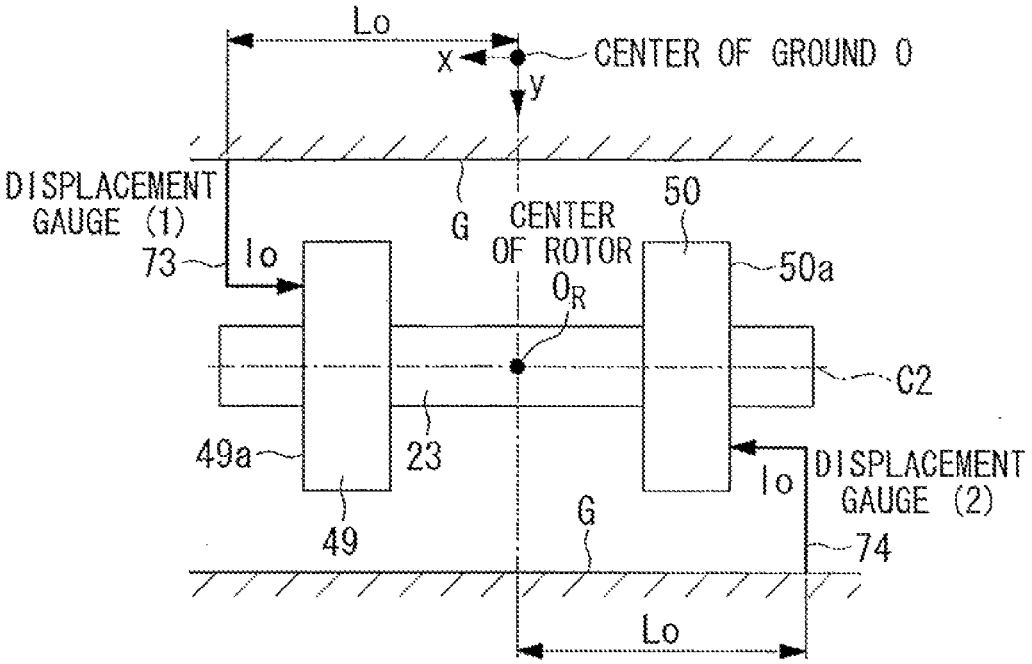
FIG. 14 is a view for explaining an equation for calculating a thermal elongation difference $\delta_1$.
Figure 15:
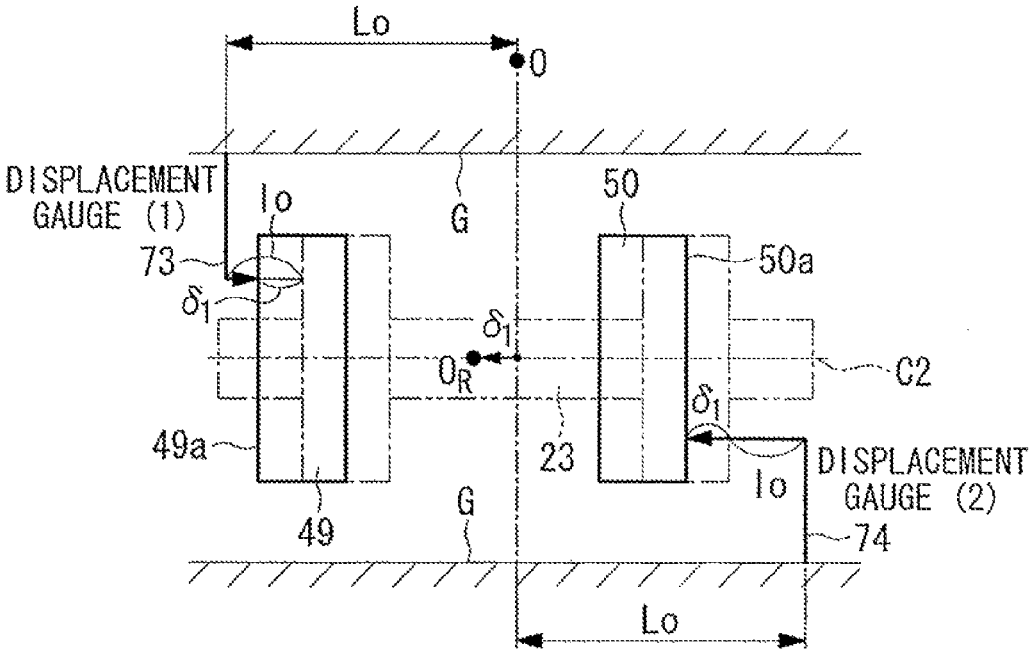
FIG. 15 is a view for explaining the equation for calculating the thermal elongation difference $\delta_1$.
Figure 16:
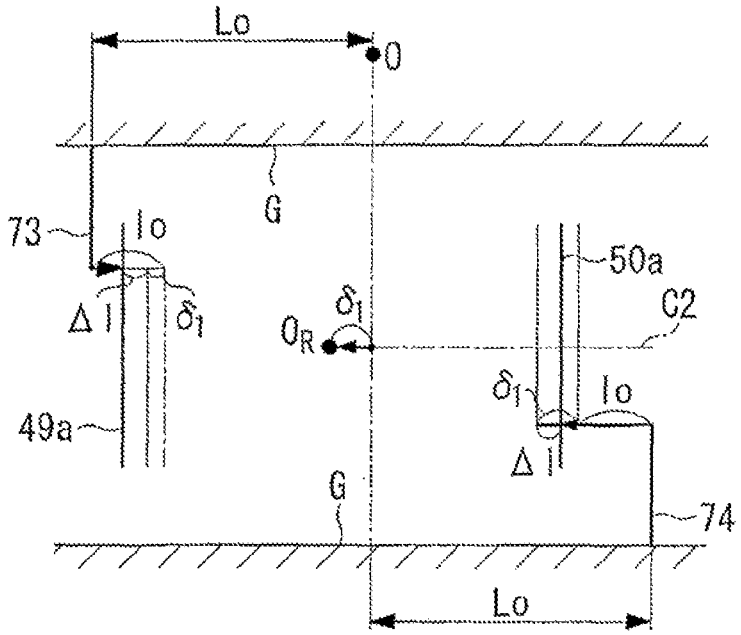
FIG. 16 is a view for explaining the equation for calculating the thermal elongation difference $\delta_1$.
Figure 17:
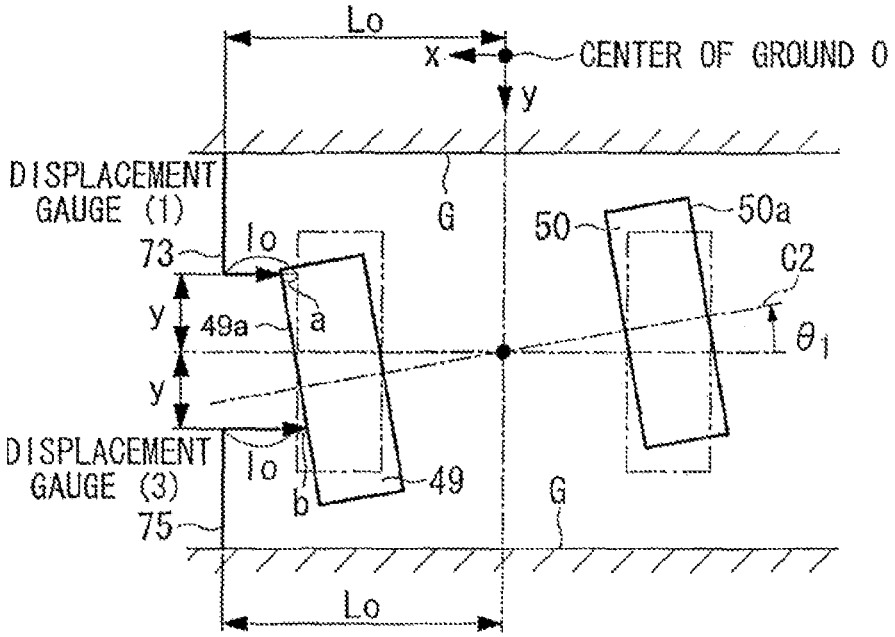
FIG. 17 is a view for explaining an equation for calculating an angle of inclination $\theta_1$.
Figure 18:
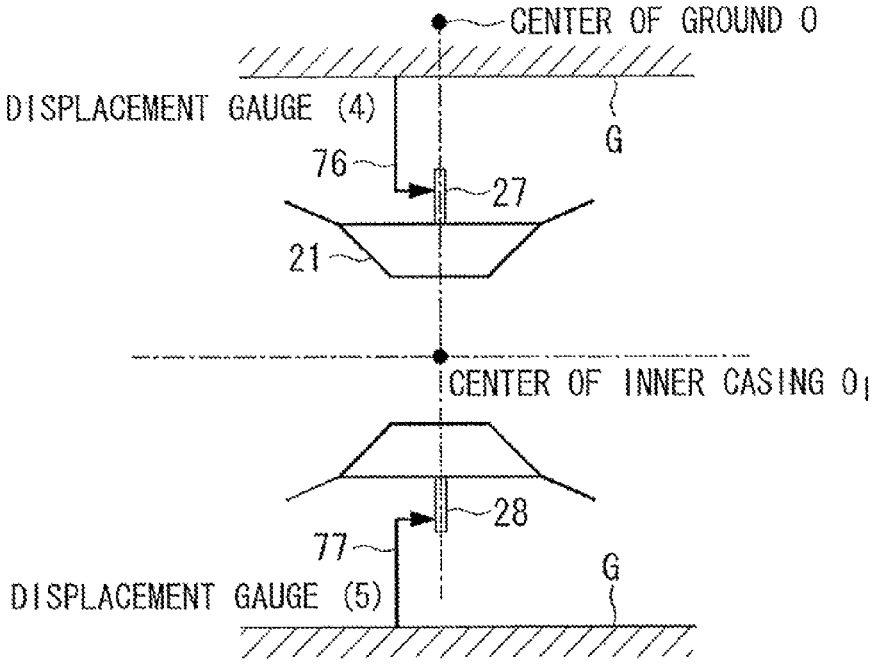
FIG. 18 is a view for explaining an equation for calculating a thermal elongation difference $\delta_2$.
Figure 19:
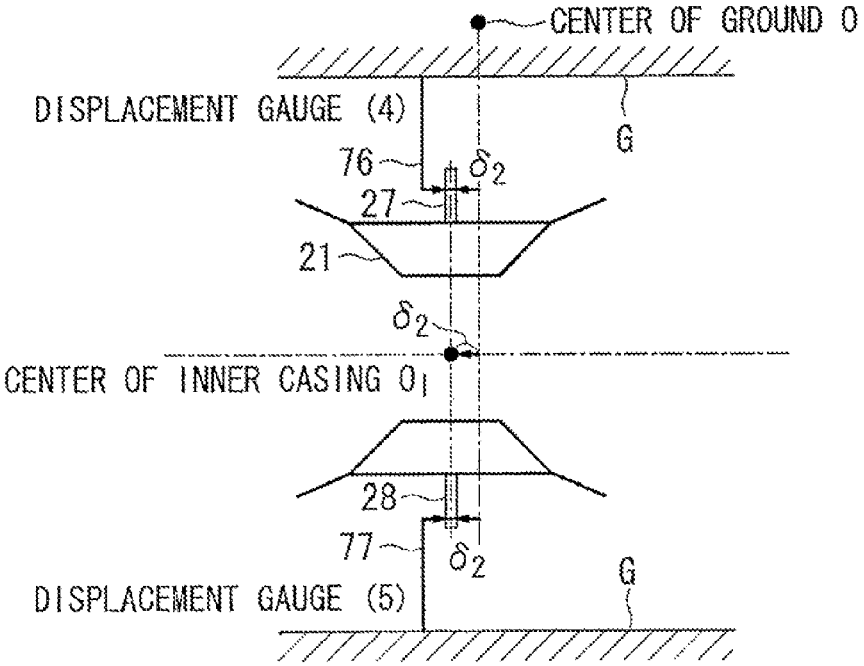
FIG. 19 is a view for explaining the equation for calculating the thermal elongation difference $\delta_2$.
Figure 20:
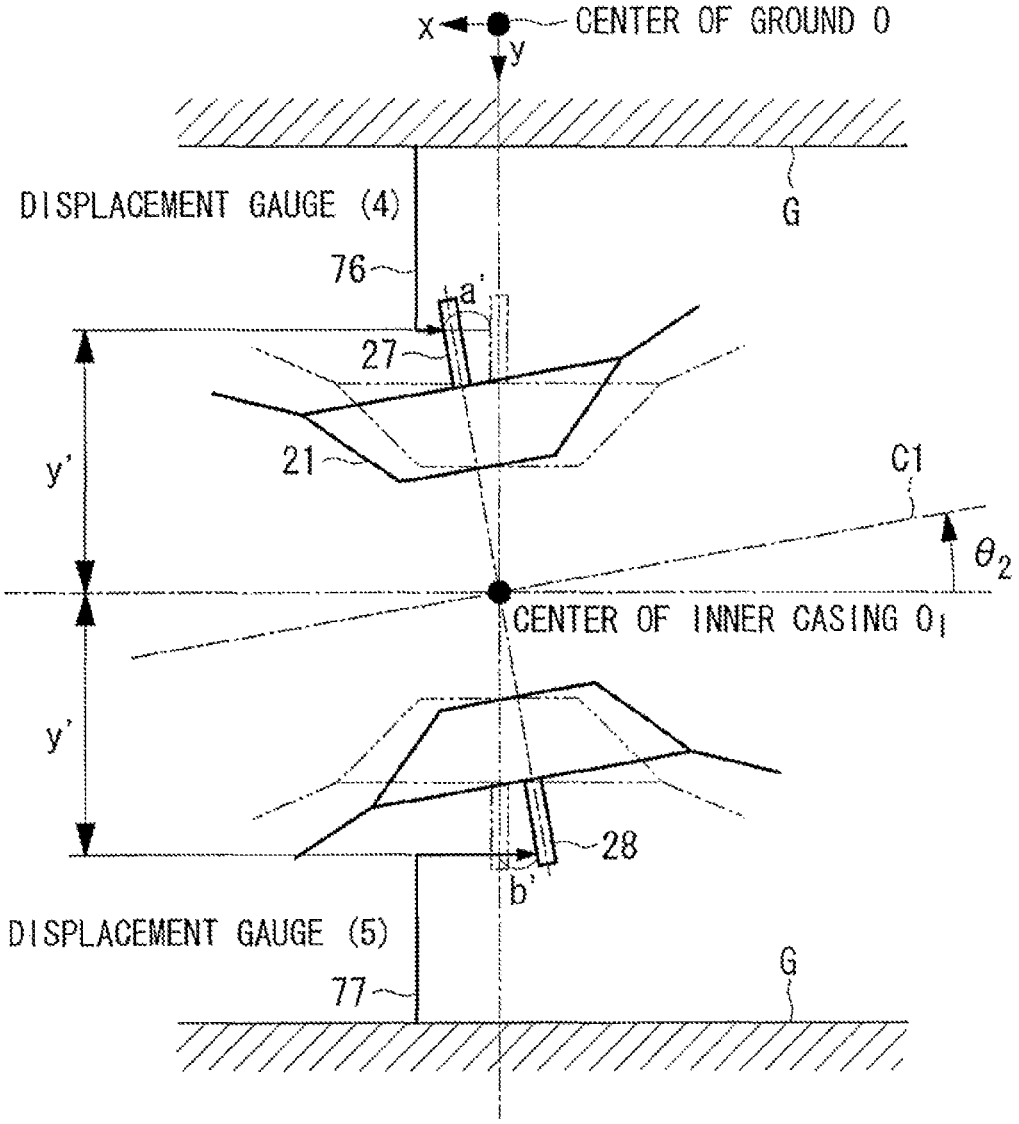
FIG. 20 is a view for explaining an equation for calculating an angle of inclination $\theta_2$.

FIG. 13 is a plan view showing, in out line, the structure of the steam turbine casing position adjusting apparatus according to this embodiment. FIGS. 14 to 16 are views for explaining an equation for calculating a thermal elongation difference $\delta_1$. FIG. 17 is a view for explaining an equation for calculating an angle of inclination $\theta_1$. FIGS. 18 and 19 are views for explaining an equation for calculating a thermal elongation difference $\delta_2$. FIG. 20 is a view for explaining an equation for calculating an angle of inclination $\theta_2$.

As shown in FIG. 13, the steam turbine casing position adjusting apparatus 40 according to this embodiment includes a (first) displacement gauge 73, a (second) displacement gauge 74, a (third) displacement gauge 75, a (fourth) displacement gauge 76, a (fifth) displacement gauge 77, the (first) actuator 14, and the (second) actuator 15.

The displacement gauge 73 is a sensor (for example, eddy-current gap sensor) that is provided (installed) outside (at the outside of) the inner casing 21 and the outer casing 22 and that measures the axial distance (gap) between a portion of the ground G where the displacement gauge 73 is fixed and an end surface (in this embodiment, an outer end surface of a flange joint 49 located farther from the thrust bearing (not shown) (surface located farther from the steam turbine ST)) 49*a* of the rotor 23 that is located outside (at the outside of) the outer casing 22.

The displacement gauge 74 is a sensor (for example, eddy-current gap sensor) that is provided (installed) outside (at the outside of) the inner casing 21 and the outer casing 22 and that measures the axial distance (gap) between a portion of the ground G where the displacement gauge 74 is fixed and an end surface (in this embodiment, an outer end surface of a flange joint 50 located closer to the thrust bearing (not shown) (surface located farther from the steam turbine ST)) 50*a* of the rotor 23 that is located outside (at the outside of) of the outer casing 22.

The displacement gauge 75 is a sensor (for example, eddy-current gap sensor) that is provided (installed) outside (at the outside of) the inner casing 21 and the outer casing 22 and that measures the axial distance (gap) between a portion of the ground G where the displacement gauge 75 is fixed and the end surface (in this embodiment, the outer end surface of the flange joint 49 located farther from the thrust bearing (not shown) (surface located farther from the steam turbine ST)) 49*a* of the rotor 23 that is located outside (at the outside of) the outer casing 22.

Note that the displacement gauge 73 and the displacement gauge 75 are provided in a horizontal plane that includes the central line Cl extending in the axial direction of the inner casing 21, on opposite sides with the central axis Cl therebetween (at positions 180 degrees away from each other in the circumferential direction).

Furthermore, the displacement gauge 75 is provided in a horizontal plane that includes the central line Cl extending in the axial direction of the inner casing 21, on the same side as the displacement gauge 74.

The displacement gauge 76 is a sensor (for example, eddy-current gap sensor) that is provided (installed) outside (at the outside of) the inner casing 21 and the outer casing 22 and that measures the axial distance (gap) between a portion of the ground G where the displacement gauge 76 is fixed and the arm 27 located outside (at the outside of) the outer casing 22.

The displacement gauge 77 is a sensor (for example, eddy-current gap sensor) that is provided (installed) outside (at the outside of) the inner casing 21 and the outer casing 22 and that measures the axial distance (gap) between a portion of the ground G where the displacement gauge 77 is fixed and the arm 28 located outside (at the outside of) the outer casing 22.

Note that the displacement gauge 76 and the displacement gauge 77 are provided in a horizontal plane that includes the central line C1 extending in the axial direction of the inner casing 21, on opposite sides with the central axis C1 therebetween (at positions 180 degrees away from each other in the circumferential direction).

Furthermore, since the actuators 14 and 15, the rotor 23, the inner casing 21, the outer casing 22, and the arms 27 and 28 are identical to those in the above-described third embodiment, a description thereof will be omitted here.

As in the above-described third embodiment, pieces of data (measurement values) measured by the displacement gauges 73, 74, 75, 76, and 77 are sent to the calculator 34, and the calculator 34 calculates the thermal elongation difference $\delta$ ($=\delta_1-\delta_2$) and the angle of inclination $\theta$($=\theta_1-\theta_2$) based on the data sent from the displacement gauges 73, 74, 75, 76, and 77.

The thermal elongation difference $\delta$ and the angle of inclination $\theta$ calculated by the calculator 34 are sent to the controller 35, and the controller 35 calculates a command value (actuation value) for making the rods 26 of the actuators 14 and 15 advance and recede, so as to cancel out (offset) the thermal elongation difference $\delta$ and the angle of inclination $\theta$ calculated by the calculator 34, so that the relative position of the inner casing 21 and the rotor 23 does not change (so that the relative position thereof is stabilized).

The command value calculated by the controller 35 is output as a command signal (actuation signal) for making the rods 26 of the actuators 14 and 15 advance and recede, is amplified by the amplifier 36, and is sent to the actuators 14 and 15. Then, the rods 26 of the actuators 14 and 15 are made to advance and recede based on the command signal, thereby moving and inclining the inner casing 21 in the axial direction and maintaining the relative position of the inner casing 21 and the rotor 23 unchanged.

Here, a method of calculating the thermal elongation difference $\delta_1$ of the rotor 23 with respect to the grounds G will be described with reference to FIGS. 14 to 16.

As described above, the displacement gauge 73 is a sensor for measuring the axial distance $X_1$ between the portion of the ground G where the displacement gauge 73 is fixed and the end surface 49*a* of the rotor 23, located outside the outer casing 22, and the displacement gauge 74 is a sensor for measuring the axial distance $X_2$ between the portion of the ground G where the displacement gauge 74 is fixed and the end surface 50*a* of the rotor 23, located outside the outer casing 22. As shown in FIG. 14, in the cold state where the steam turbine ST is shut down (in the state in which the thermal elongation difference $\delta$ and/or the angle of inclination $\theta$ has not been produced), the displacement gauges 73 and 74 are installed (initially set) at positions away from the center $O_R$ of the rotor 23 in the axial direction by an identical distance $L_O$ such that pieces of data (measurement values) measured by the displacement gauges 73 and 74 become equal ($l_O$ in this embodiment), specifically, such that the axial distance $X_1$ between the portion of the ground G where the displacement gauge 73 is fixed and the end surface 49*a* of the rotor 23, located outside the outer casing 22, becomes $-l_O$, and the axial distance $X_2$ between the portion of the ground G where the displacement gauge 74 is fixed and the end surface 50*a* of the rotor 23, located outside the outer casing 22, becomes $+l_O$.

Note that, in the cold state where the steam turbine ST is shut down, the center $O_R$ of the rotor 23 and the arms 27 and 28 are located in a vertical plane that includes the axiswise middle of the inner casing 21.

Next, when another steam turbine (not shown) that is different from the steam turbine ST is disposed between the steam turbine ST and the thrust bearing (not shown) (when the steam turbine ST is, for example, a low-pressure turbine farthest from the thrust bearing), the influence of a thermal elongation of a rotor (not shown) constituting the steam turbine disposed between the steam turbine ST and the thrust bearing appears as the thermal elongation difference $\delta_1$, as shown in FIG. 15. At this time, the axial distance $X_1$ between the portion of the ground G where the displacement gauge 73 is fixed and the end surface 49*a* of the rotor 23, located outside the outer casing 22, is $-l_O+\delta_1$, and the axial distance $X_2$ between the portion of the ground G where the displacement gauge 74 is fixed and the end surface 50*a* of the rotor 23, located outside the outer casing 22, is $l_O+\delta_1$. From the equations $X_1=-l_O+\delta_1$ and $X_2=l_O+\delta_1$, an equation for the thermal elongation difference $\delta_1=(X_1+X_2)/2$ can be derived. Specifically, the thermal elongation difference $\delta_1$ can be easily calculated by calculating the sum of the axial, distance $X_1$ between the portion of the ground G where the displacement gauge 73 is fixed and the end surface 49*a* of the rotor 23, located outside the outer casing 22, which is measured by the displacement gauge 73, and the axial distance $X_2$ between the portion of the ground G where the displacement gauge 74 is fixed and the end surface 50*a* of the rotor 23, located outside the outer casing 22, which is measured by the displacement gauge 74, and by dividing the sum by 2.

Next, as shown in FIG. 16, when the thermal elongation difference $\Delta l$ inherent to the rotor 23 constituting the steam turbine ST is considered, the axial distance $X_1$ between the portion of the ground G where the displacement gauge 73 is fixed and the end surface 49*a* of the rotor 23, located outside the outer casing 22, is $-l_O+\delta_1+\Delta l$, and the axial distance $X_2$ between the portion of the ground G where the displacement gauge 74 is fixed and the end surface 50*a* of the rotor 23, located outside the outer casing 22, is $l_O+\delta_1-\Delta l$. Then, from the equations $X_1=-l_O+\delta_1+\Delta l$ and $X_2=l_O+\delta_1-\Delta l$, an equation for the thermal elongation difference $\delta_1=(X_1+X_2)/2$ can be derived. Specifically, the thermal elongation difference $\delta_1$ can be easily calculated by calculating the sum of the axial distance $X_1$ between the portion of the ground G where the displacement gauge 73 is fixed and the end surface 49*a* of the rotor 23, located outside the outer casing 22, which is measured by the displacement gauge 73, and the axial distance $X_2$ between the portion of the ground G where the displacement gauge 74 is fixed and the end surface 50*a* of the rotor 23, located outside the outer casing 22, which is measured by the displacement gauge 74, and by dividing the sum by 2. In this way, the thermal elongation difference $\delta_1$ can be easily calculated by using the equation $(X_1+X_2)/2$, independently of whether the thermal elongation difference $\Delta l$ inherent to the rotor 23 constituting the steam turbine ST is considered or not.

Next, a method of calculating the angle of inclination $\theta_1$ of the rotor 23 with respect to the grounds G will be described with reference to FIG. 17.

As described above, the displacement gauges 73 and 75 are sensors for respectively measuring the axial distances $X_1$ and $X_3$ between the portions of the grounds G where the displacement gauges 73 and 75 are fixed and the end surface 49*a* of the rotor 23, located outside the outer casing 22. As indicated by the two-dot chain lines in FIG. 17, in the cold state where the steam turbine ST is shut down (in the state in which the thermal elongation difference $\delta$ and/or the angle of inclination $\theta$ has not been produced), the displacement gauges 73 and 75 are installed (initially set) such that pieces of data (measurement values) measured by the displacement gauges 73 and 75 become equal ($l_O$ in this embodiment), specifically, such that the axial distance $X_1$ between the portion of the ground G where the displacement gauge 73 is fixed and the end surface 49*a* of the rotor 23, located outside the outer casing 22, becomes $-l_O$, and the axial distance $X_3$ between the portion of the ground G where the displacement gauge 75 is fixed and the end surface 49*a* of the rotor 23, located outside the outer casing 22, becomes $-l_O$.

Next, as indicated by the solid lines in FIG. 17, if the rotor 23 constituting the steam turbine ST is inclined with respect to the grounds G by the angle of inclination $\theta_1$, the axial distance $X_1$ between the portion of the ground G where the displacement gauge 73 is fixed and the end surface 49*a* of the rotor 23, located outside the outer casing 22, is $-l_O+a$, and the axial distance $X_3$ between the portion of the ground G where the displacement gauge 75 is fixed and the end surface 49*a* of the rotor 23, located outside the outer casing 22, is $-l_O-b$. From the equations $X_1=-l_O+a$ and $X_3=-l_O-b$, an equation $X_1-X_3=a+b$ can be derived. Furthermore, the angle of inclination $\theta_1$ can be easily calculated by using an equation for the angle of inclination $\theta_1=\tan^{-1}((a+b)/2y)$, specifically, $\theta_1=\tan^{-1}((X_1-X_3)/2y)$.

Note that y is the distance in the y direction (see FIG. 17) from the center $O_R$ of the rotor 23 to the center (base point) of a measuring part (sensor part) of each of the displacement gauges 73 and 75.

Next, a method of calculating the thermal elongation difference $\delta_2$ of the inner casing 21 with respect to the grounds G will be described with reference to FIGS. 18 and 19.

As described above, the displacement gauge 76 is a sensor for measuring the axial distance between the portion of the ground G where the displacement gauge 76 is fixed and the arm 27 located outside (at the outside of) the outer casing 22, specifically, an axial distance $X_4$ between the portion of the ground G where the displacement gauge 76 is fixed and the middle (center) of the inner casing 21 in the axial direction (horizontal direction in FIG. 13), and the displacement gauge 77 is a sensor for measuring the axial distance between the portion of the ground G where the displacement gauge 77 is fixed and the arm 28 located outside (at the outside of) the outer casing 22, specifically, an axial distance $X_5$ between the portion of the ground G where the displacement gauge 77 is fixed and the middle (center) of the inner casing 21 in the axial direction (horizontal direction in FIG. 13). As shown in FIG. 18, in the cold state where the steam turbine ST is shut down (in the state in which the thermal elongation difference $\delta$ and/or the angle of inclination $\theta$ has not been produced), the displacement gauges 76 and 77 are installed (initially set) such that pieces of data (measurement values) measured by the displacement gauges 76 and 77 become equal ($l_O$ in this embodiment), specifically, such that the axial distance $X_4$ between the portion of the ground G where the displacement gauge 76 is fixed and the arm 27 located outside (at the outside of) the outer casing 22 becomes $-l_O$, and the axial distance $X_5$ between the portion of the ground G where the displacement gauge 77 is fixed and the arm 28 located outside (at the outside of) the outer casing 22 becomes $-l_O$.

Next, as shown in FIG. 19, when the thermal elongation difference $\delta_2$ of the inner casing 21 constituting the steam turbine ST with respect to the grounds G is considered, the axial distance $X_4$ between the portion of the ground G where the displacement gauge 76 is fixed and the arm 27 located outside (at the outside of) the cuter casing 22 is $-l_O+\delta_2$, and the axial distance $X_5$ between the portion of the ground G where the displacement gauge 77 is fixed and the arm 28 located outside (at the outside of) the outer casing 22 is $-l_O+\delta_2$. Then, from the equations $X_4=-l_O+\delta_2$ and $X_5=-l_O+\delta_2$, equations for the thermal elongation difference $\delta_2=l_O+X_4$ and $\delta_2=l_O+X_5$ can be derived. Specifically, the thermal elongation difference $\delta_2$ can be easily calculated by subtracting $l_O$, which is an initial set value (known value), from data measured by the displacement gauge 76 or the displacement gauge 77. Furthermore, the thermal elongation difference $\delta$ can be easily calculated by subtracting the thermal elongation difference $\delta_2$ from the above-described thermal elongation difference $\delta_1$.

Next, a method of calculating an angle of inclination $\theta_2$ of the inner casing 21 with respect to the grounds G will be described with reference to FIG. 20.

As described above, the displacement gauges 76 and 77 are sensors for measuring the axial distances $X_4$ and $X_5$ between the portions of the grounds G where the displacement gauges 76 and 77 are fixed and the arms 27 and 28 located outside (at the outsides of) of the outer casing 22, respectively. As indicated by the two-dot chain lines in FIG. 20, in the cold state where the steam turbine ST is shut down (in the state in which the thermal elongation difference $\delta$ and/or the angle of inclination $\theta$ has not been produced), the displacement gauges 76 and 77 are installed (initially set) such that pieces of data (measurement values) measured by the displacement gauges 76 and 77 become equal ($l_O$ in this embodiment), specifically, such that the axial distance $X_4$ between the portion of the ground G where the displacement gauge 76 is fixed and the arm 27 located outside the outer casing 22 becomes $-l_O$, and the axial distance $X_5$ between the portion of the ground G where the displacement gauge 77 is fixed and the arm 28 located outside the outer casing 22 becomes $-l_O$.

Next, as indicated by the solid lines in FIG. 20, if the inner casing 21 constituting the steam turbine ST is inclined with respect to the grounds G by the angle of inclination $\theta_2$, the axial distance $X_4$ between the portion of the ground G where the displacement gauge 76 is fixed and the arm 27 located outside the outer casing 22 is $-l_O+a'$, and the axial distance $X_5$ between the portion of the ground G where the displacement gauge 77 is fixed and the arm 28 located outside the outer casing 22 is $-l_O-b'$. From the equations $X_4=-l_O+a'$ and $X_5=-l_O-b'$, an equation $X_4-X_5=a'+b'$ can be derived. Furthermore, the angle of inclination $\theta_2$ can be easily calculated by using an equation for the angle of inclination $\theta_2=\tan^{-1}((a'+b')/2y')$, specifically, $\theta_2=\tan^{-1}((X_4-X_5)/2y')$. Furthermore, the angle of inclination $\theta$ can be easily calculated by subtracting the angle of inclination $\theta_2$ from the above-described angle of inclination $\theta_1$. Then, the rods 26 of the actuators 14 and 15 are made to advance and recede such that the calculated thermal elongation difference $\delta$ and/or angle of inclination $\theta$ are cancelled out (offset: set to zero); thus, even in the hot state where the steam turbine ST is operated (in the state in which the thermal elongation difference $\delta$ and/or the angle of inclination $\theta$ has been produced), the center $O_R$ of the rotor 23 is located in a vertical plane that includes the axiswise middle (center $O_1$) of the inner casing 21, and the relative position of the inner casing 21 and the rotor 23 is maintained unchanged (so as to be stabilized).

Note that y' is the distance in the y direction (see FIG. 20) from the center $O_1$ of the inner casing 21 to the center (base point) of a measuring part (sensor part) of each of the displacement gauges 76 and 77.

According to the steam turbine casing position adjusting apparatus 40 of this embodiment, the actuators 14 and 15 are controlled such that the thermal elongation difference $\delta$ of the rotor 23 in the axial direction with respect to the inner casing 21 and/or the angle of inclination $\theta$ of the rotor 23 with respect to the inner casing 21 are cancelled out (offset: set to zero); thus, even in the hot state where the steam turbine ST is operated (in the state in which the thermal elongation difference $\delta$ and/or the angle of inclination $\theta$ has been produced), the relative position of the inner casing 21 and the rotor 23 is maintained unchanged (so as to be stabilized).

Thus, it is possible to reduce the clearance between the inner casing (turbine casing) 21 and the rotor 23 and to improve the efficiency of the turbine.

Furthermore, according to the steam turbine casing position adjusting apparatus 40 of this embodiment, inclination and a thermal elongation of the inner casing 21 with respect to the grounds G due to thermal expansion thereof are considered.

Thus, it is possible to more accurately measure the thermal elongation difference due to the relative thermal expansion of the inner casing 21 and the rotor 23, to reduce the clearance between the inner casing 21 and the rotor 23, and to improve the efficiency of the turbine.

Furthermore, according to the steam turbine casing position adjusting apparatus 40 of this embodiment, the displacement gauges 73, 74, 75, 76, and 77 and the actuators 14 and 15 are provided outside the outer casing 22, so that they are not exposed to high-temperature steam.

Thus, it is possible to reduce the occurrence of thermal damage and failure of the displacement gauges 73, 74, 75, 76, and 77 and the actuators 14 and 15, to lengthen the lives thereof, and to improve the reliability of the displacement gauges 73, 74, 75, 76, and 77 and the actuators 14 and 15.

Fifth Embodiment

A steam turbine casing position adjusting apparatus according to a fifth embodiment of the present invention will be described below with reference to FIGS. 21 to 29.

Figure 21:
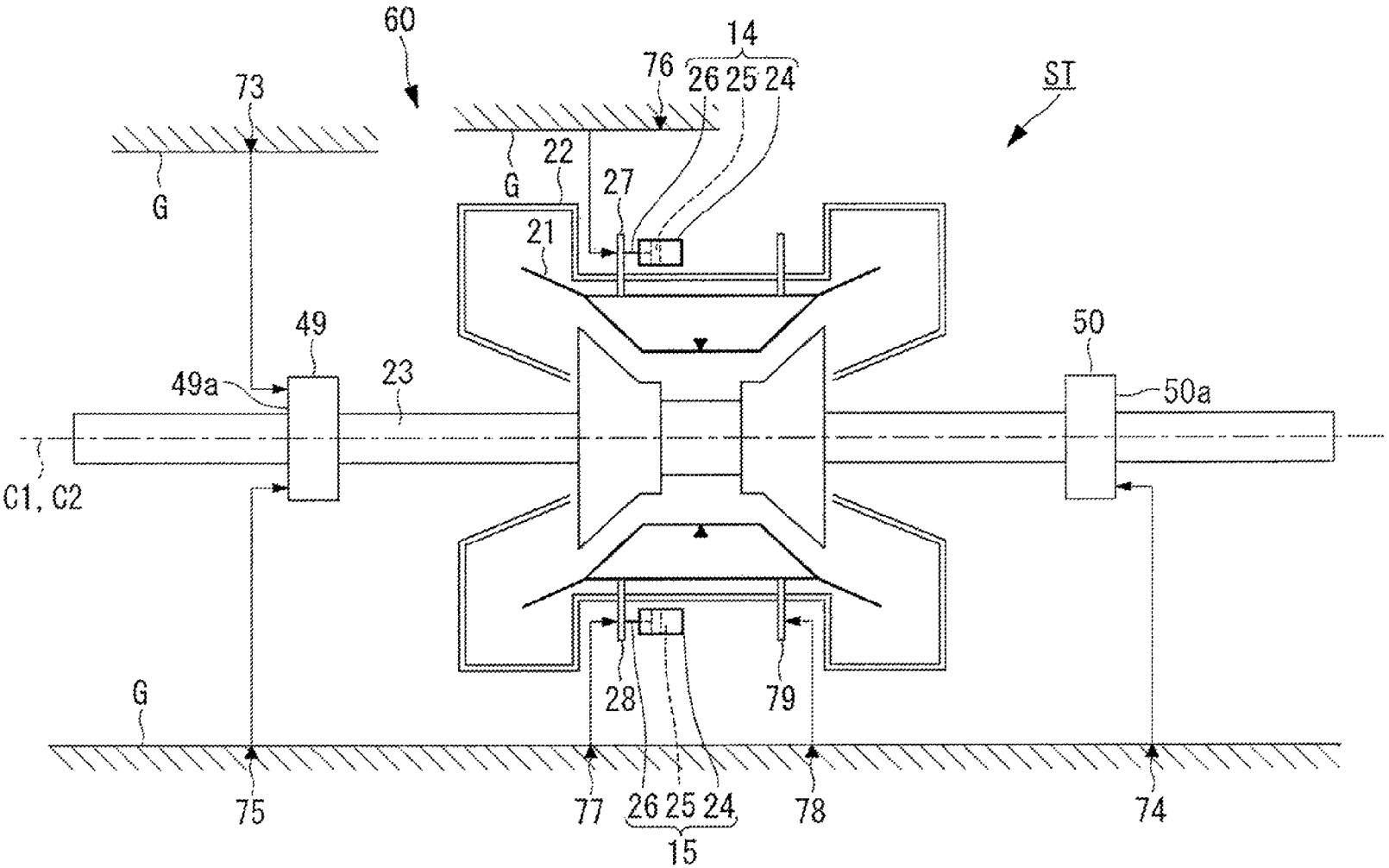
FIG. 21 is a plan view showing, in outline, the structure of a steam turbine casing position adjusting apparatus according to a fifth embodiment of the present invention.
Figure 22:
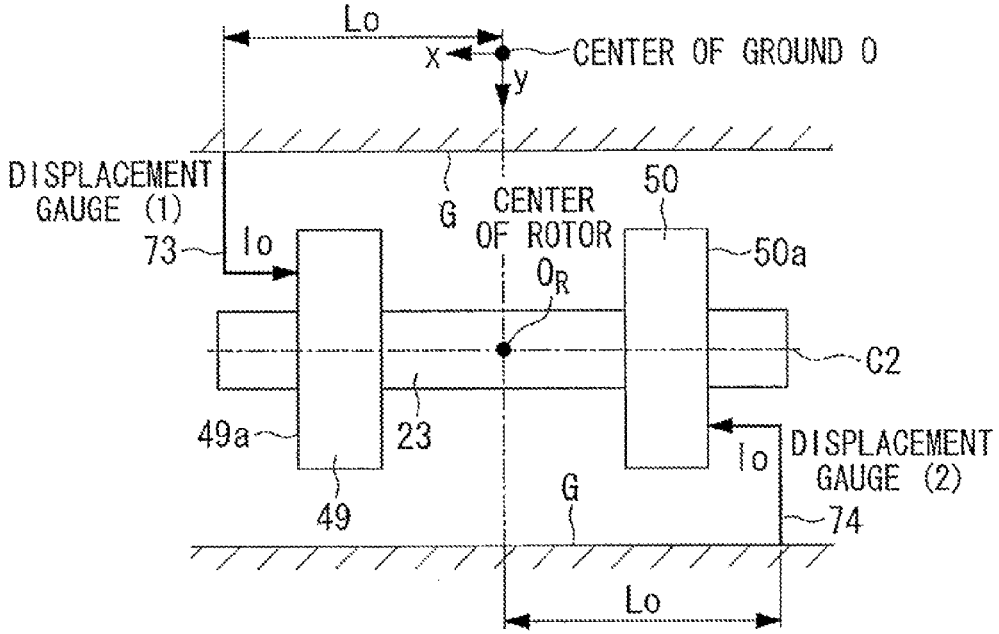
FIG. 22 is a view for explaining an equation for calculating a thermal elongation difference $\delta_1$.
Figure 23:
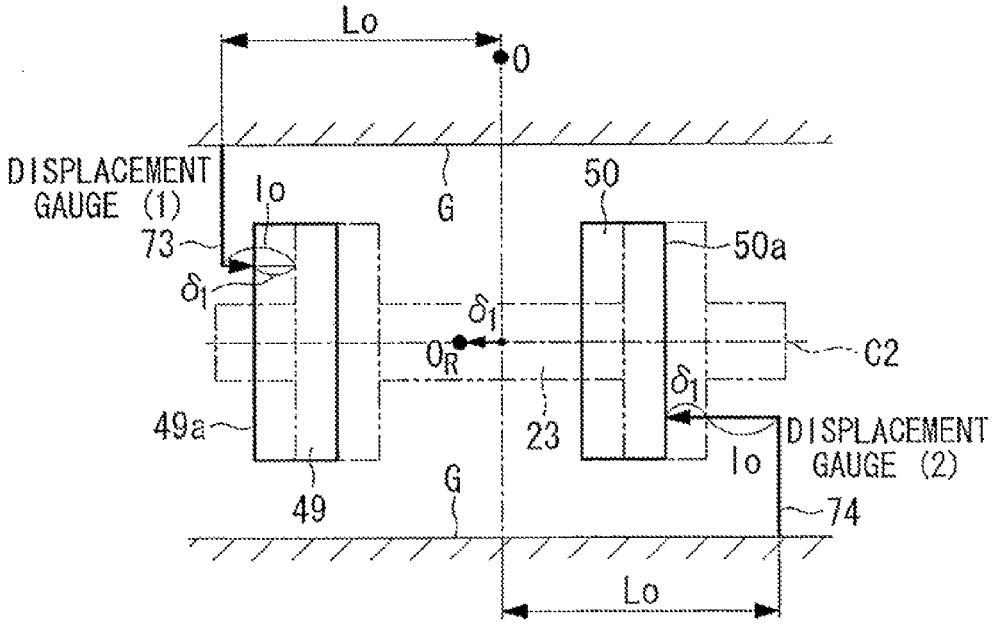
FIG. 23 is a view for explaining the equation for calculating the thermal elongation difference $\delta_1$.
Figure 24:
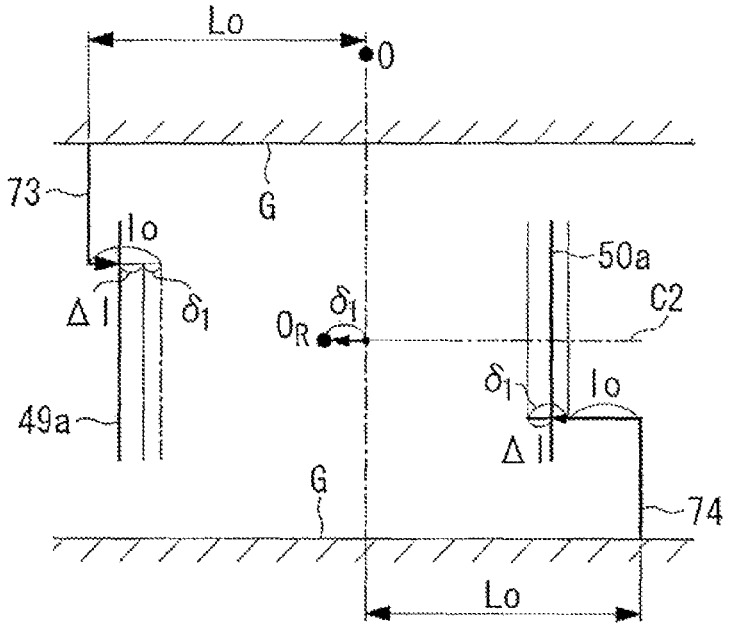
FIG. 24 is a view for explaining the equation for calculating the thermal elongation difference $\delta_1$.
Figure 25:
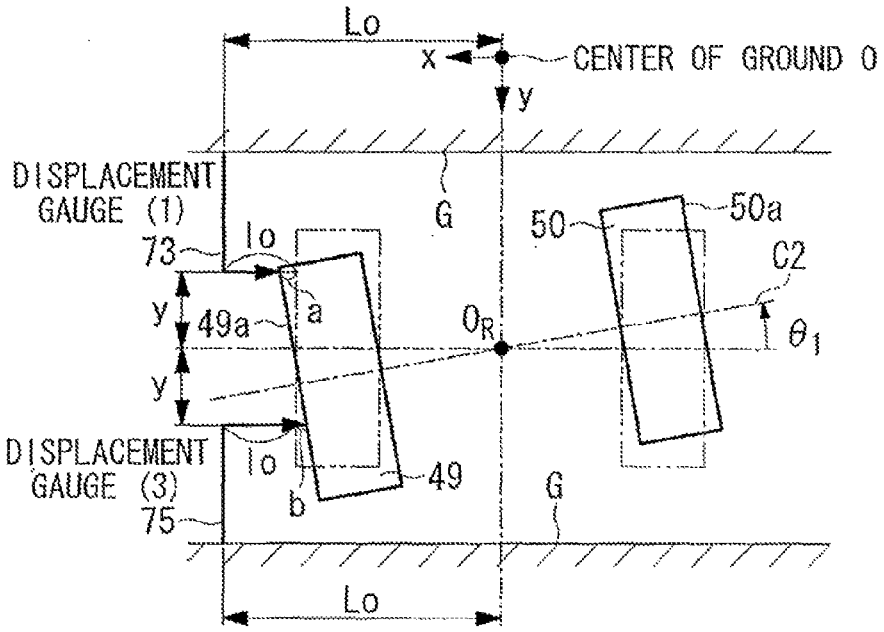
FIG. 25 is a view for explaining an equation for calculating an angle of inclination $\theta_1$.
Figure 26:
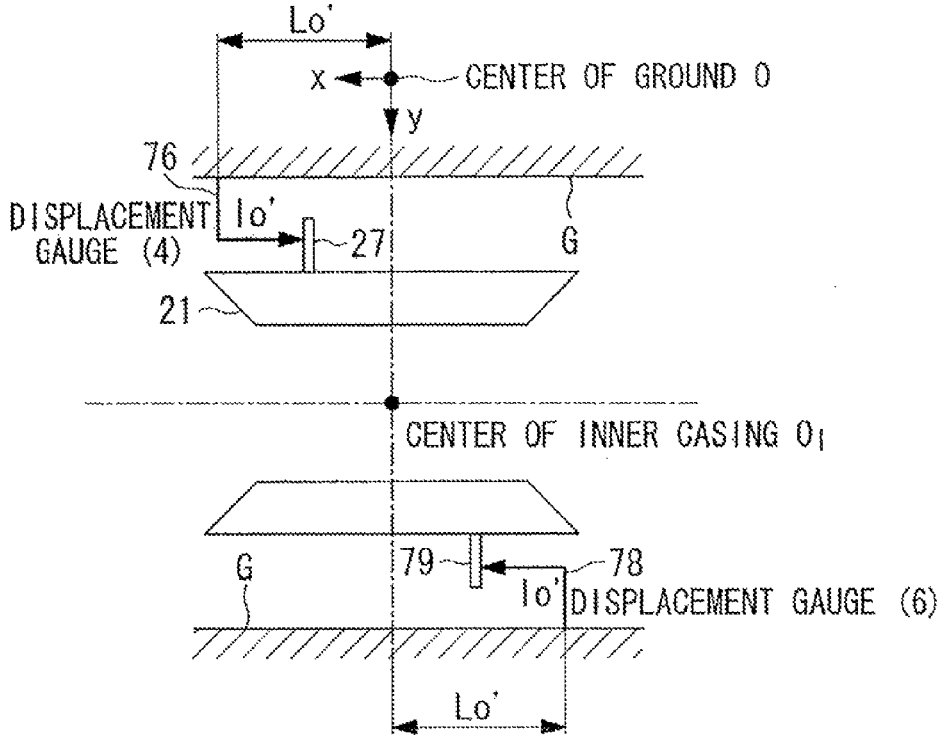
FIG. 26 is a view for explaining an equation for calculating a thermal elongation difference $\delta_2$.
Figure 27:
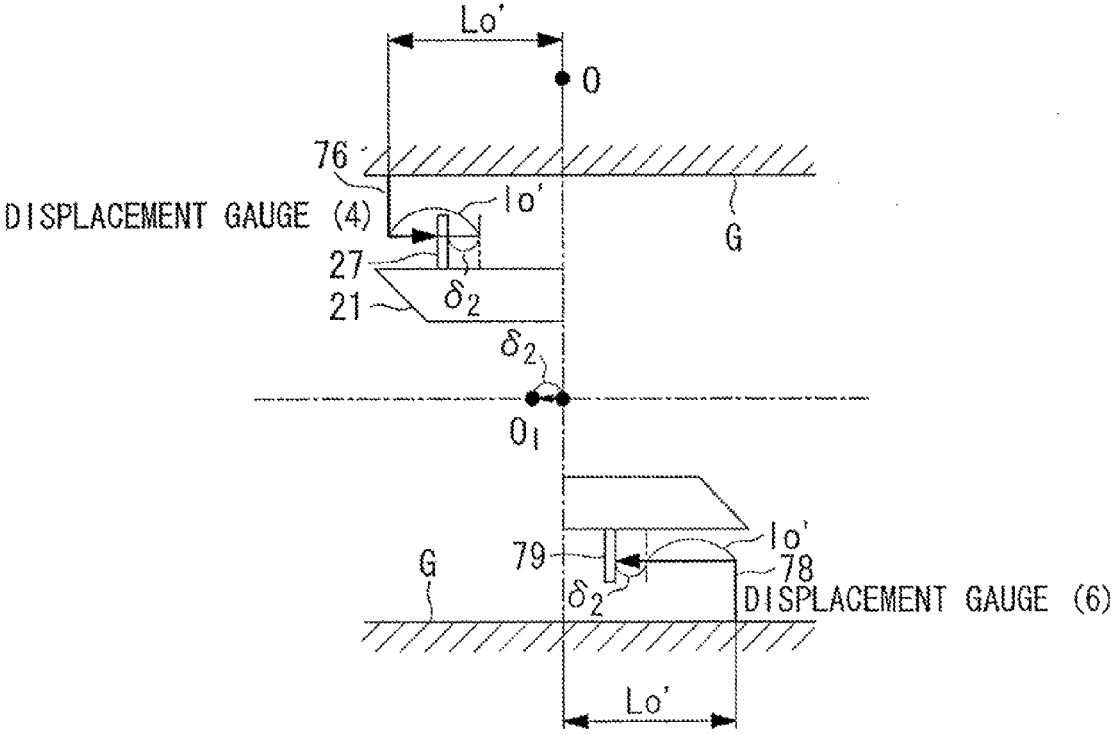
FIG. 27 is a view for explaining the equation for calculating the thermal elongation difference $\delta_2$.
Figure 28:
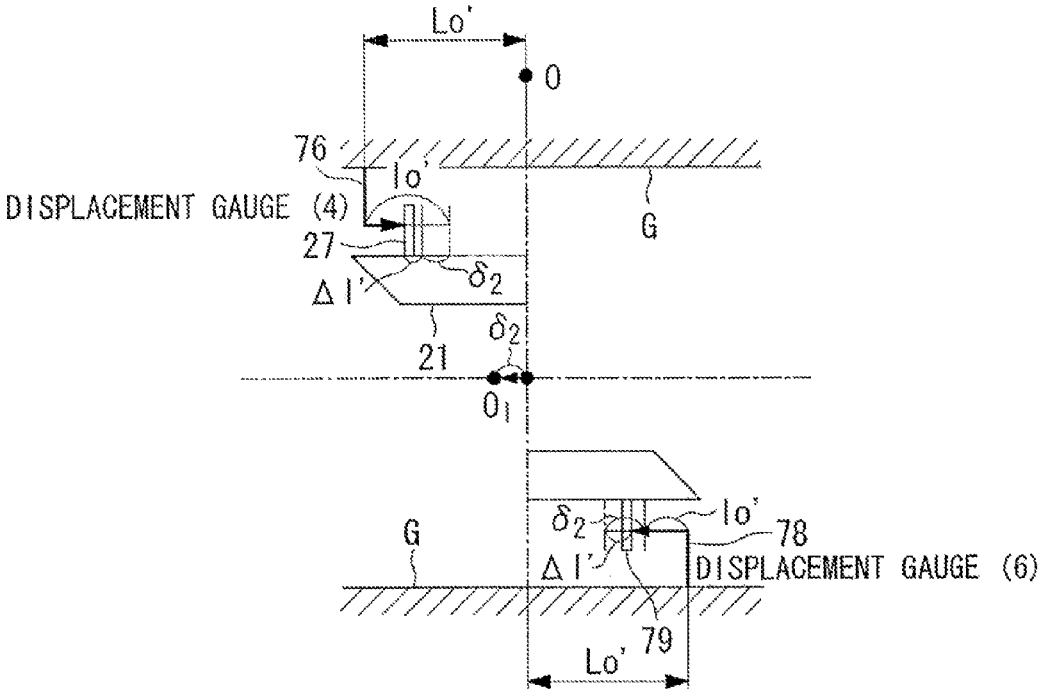
FIG. 28 is a view for explaining the equation for calculating the thermal elongation difference $\delta_2$.
Figure 29:
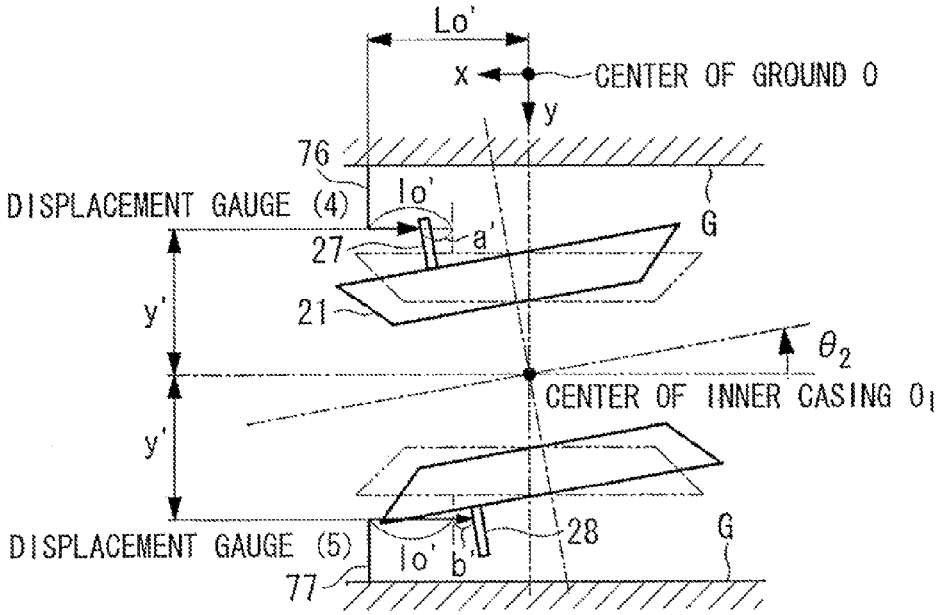
FIG. 29 is a view for explaining an equation for calculating an angle of inclination $\theta_2$.

FIG. 21 is a plan view showing, in outline, the structure of the steam turbine casing position adjusting apparatus according to this embodiment. FIGS. 22 to 24 are views for explaining an equation for calculating the thermal elongation difference $\delta_1$. FIG. 25 is a view for explaining an equation for calculating the angle of inclination $\theta_1$. FIGS. 26 to 28 are views for explaining an equation for calculating the thermal elongation difference $\delta_2$. FIG. 29 is a view for explaining an equation for calculating the angle of inclination $\theta_2$.

As shown in FIG. 21, a steam turbine casing position adjusting apparatus 60 according to this embodiment includes the (first) displacement gauge 73, the (second) displacement gauge 74, the (third) displacement gauge 75, the (fourth) displacement gauge 76, the (fifth) displacement gauge 77, a (sixth) displacement gauge 78, the (first) actuator 14, and the (second) actuator 15.

The displacement gauge 78 is a sensor (for example, eddy-current gap sensor) that is provided (installed) outside (at the outside of) the inner casing 21 and the outer casing 22 and that measures the axial distance (gap) between a portion of the ground G where the displacement gauge 78 is fixed and an arm 79 located outside (at the outside of) the outer casing 22.

Note that the displacement gauge 78 is provided in a horizontal plane that includes the central line C1 extending in the axial direction of the inner casing 21, on the same side as the displacement gauge 77.

Furthermore, the arms 2 and 28 of this embodiment are provided at positions shifted from the middle (center) of the inner casing 21 in the axial direction (horizontal direction in FIG. 21) toward the flange joint 49 (toward the side farther from the thrust bearing (not shown)) by a predetermined distance ($L_O'-l_O'$).

Furthermore, the arm 79 of this embodiment is provided at a position shifted from the middle (center) of the inner casing 21 in the axial direction (horizontal direction in FIG. 21) toward the flange joint 50 (toward the side closer to the thrust bearing (not shown)) by a predetermined distance ($-L_O'+l_O'$).

Furthermore, since the actuators 14 and 15, the rotor 23, the inner casing 21, the outer casing 22, the arms 27 and 28, and the displacement gauges 73, 74, 75, 76, and 77 are identical to those in the above-described fourth embodiment, a description thereof will be omitted here.

As in the above-described fourth embodiment, pieces of data (measurement values) measured by the displacement gauges 73, 74, 75, 76, 77, and 78 are sent to the calculator 34, and the calculator 34 calculates a thermal elongation difference $\delta$ ($=\delta_1-\delta_2$) and an angle of inclination $\theta$ ($=\theta_1-\theta_2$) based on the data sent from the displacement gauges 73, 74, 75, 76, 77, and 78.

The thermal elongation difference $\delta$ and the angle of inclination $\theta$ calculated by the calculator 34 are sent to the controller 35, and the controller 35 calculates a command value (actuation value) for making the rods 26 of the actuators 14 and 15 advance and recede, so as to cancel out (offset) the thermal elongation difference $\delta$ and the angle of inclination $\theta$ calculated by the calculator 34, so that the relative position of the inner casing 21 and the rotor 23 does not change (so that the relative position thereof is stabilized.

The command value calculated by the controller 35 is output as a command signal (actuation signal) for making the rods 26 of the actuators 14 and 15 advance and recede, is amplified by the amplifier 36, and is sent to the actuators 14 and 15. Then, the rods 26 of the actuators 14 and 15 are made to advance and recede based on the command signal, thereby moving and inclining the inner casing 21 in the axial direction and maintaining the relative position of the inner casing 21 and the rotor 23 unchanged.

Here, a method of calculating the thermal elongation difference $\delta_1$ of the rotor 23 with respect to the grounds G will be described with reference to FIGS. 22 to 24.

As described above, the displacement gauge 73 is a sensor for measuring the axial distance $X_1$ between the portion of the ground G where the displacement gauge 73 is fixed and the end surface 49*a* of the rotor 23, located outside the outer casing 22, and the displacement gauge 74 is a sensor for measuring the axial distance $X_2$ between the portion of the ground G where the displacement gauge 74 is fixed and the end surface 50*a* of the rotor 23, located outside the outer casing 22. As shown in FIG. 22, in the cold state where the steam turbine ST is shut down (in the state in which the thermal elongation difference $\delta$ and/or the angle of inclination $\theta$ has not been produced), the displacement gauges 73 and 74 are installed (initially set) at positions away from the center $O_R$ of the rotor 23 in the axial direction by the identical distance $L_O$ such that pieces of data (measurement values) measured by the displacement gauges 73 and 74 become equal ($l_O$ in this embodiment), specifically, such that the axial distance $X_1$ between the portion of the ground G where the displacement gauge 73 is fixed and the end surface 49*a* of the rotor 23, located outside the outer casing 22, becomes $-l_O$, and the axial distance $X_2$ between the portion of the ground G where the displacement gauge 74 is fixed and the end surface 50*a* of the rotor 23, located outside the outer casing 22, becomes $+l_O$.

Next, when another steam turbine (not shown) that is different from the steam turbine ST is disposed between the steam turbine ST and the thrust bearing (not shown) (when the steam turbine ST is, for example, a low-pressure turbine farthest from the thrust bearing), the influence of a thermal elongation of a rotor (not shown) constituting the steam turbine disposed between the steam turbine ST and the thrust bearing appears as the thermal elongation difference $\delta_1$, as shown in FIG. 23. At this time, the axial distance $X_1$ between the portion of the ground G where the displacement gauge 73 is fixed and the end surface 49*a* of the rotor 23, located outside the outer casing 22, is $-l_O+\delta_1$, and the axial distance $X_2$ between the portion of the ground G where the displacement gauge 74 is fixed and the end surface 50*a* of the rotor 23, located outside the outer casing 22, is $l_O+\delta_1$. From the equations $X_1=-l_O+\delta_1$, and $X_2=l_O+\delta_1$, an equation for the thermal elongation difference $\delta_1=(X_1+X_2)/2$ can be derived. Specifically, the thermal elongation difference $\delta_1$ can be easily calculated by calculating the sum of the axial distance $X_1$ between the portion of the ground G where the displacement gauge 73 is fixed and the end surface 49*a* of the rotor 23, located outside the outer casing 22, which is measured by the displacement gauge 73, and the axial distance $X_2$ between the portion of the ground G where the displacement gauge 74 is fixed and the end surface 50*a* of the rotor 23, located outside the outer casing 22, which is measured by the displacement gauge 74, and by dividing the sum by 2.

As shown in FIG. 24, when the thermal elongation difference $\Delta l$ inherent to the rotor 23 constituting the steam turbine ST is considered, the axial distance $X_1$ between the portion of the ground G where the displacement gauge 73 is fixed and the end surface 49*a* of the rotor 23, located outside the outer casing 22, is $-l_O+\delta_1+\Delta l$, and the axial distance $X_2$ between the portion of the ground G where the displacement gauge 74 is fixed and the end surface 50*a* of the rotor 23, located outside the outer casing 22, is $l_O+\delta_1-\Delta l$. Then, from the equations $X_1=-l_O+\delta_1+\Delta l$ and $X_2=l_O+\delta_1-\Delta l$, an equation for the thermal elongation difference $\delta_1=(X_1+X_2)/2$ can be derived. Specifically, the thermal elongation difference $\delta_1$ can be easily calculated by calculating the sum of the axial distance $X_1$ between the portion of the ground G where the displacement gauge 73 is fixed and the end surface 49*a* of the rotor 23, located outside the outer casing 22, which is measured by the displacement gauge 73, and the axial distance $X_2$ between the portion of the ground G where the displacement gauge 74 is fixed and the end surface 50*a* of the rotor 23, located outside the outer casing 22, which is measured by the displacement gauge 74, and by dividing the sum by 2. In this way, the thermal elongation difference $\delta_1$ can be easily calculated by using the equation $(X_1+X_2)/2$, independently of whether the thermal elongation difference $\Delta l$ inherent to the rotor 23 constituting the steam turbine ST is considered or not.

Next, a method of calculating the angle of inclination $\theta_1$ of the rotor 23 with respect to the grounds G will be described with reference to FIG. 25.

As described above, the displacement gauges 73 and 75 are sensors for respectively measuring the axial distances $X_1$ and $X_3$ between the portions of the grounds G where the displacement gauges 73 and 75 are fixed and the end surface 49*a* of the rotor 23, located outside the outer casing 22. As indicated by the two-dot chain lines in FIG. 25, in the cold state where the steam turbine ST is shut down (in the state in which the thermal elongation difference δ and/or the angle of inclination θ has not been produced), the displacement gauges 73 and 75 are installed (initially set) such that pieces of data (measurement values) measured by the displacement gauges 73 and 75 become equal ($l_O$ in this embodiment), specifically, such that the axial distance $X_1$ between the portion of the ground G where the displacement gauge 73 is fixed and the end surface 49*a* of the rotor 23, located outside the outer casing 22, becomes $-l_O$, and the axial distance $X_3$ between the portion of the ground G where the displacement gauge 75 is fixed and the end surface 49*a* of the rotor 23, located outside the outer casing 22, becomes $-l_O$.

Next, as indicated by the solid lines in FIG. 25, if the rotor 23 constituting the steam turbine ST is inclined with respect to the grounds G by the angle of inclination $\theta_1$, the axial distance $X_1$ between the portion of the ground G where the displacement gauge 73 is fixed and the end surface 49*a* of the rotor 23, located outside the outer casing 22, is $-l_O+a$, and the axial distance $X_3$ between the portion of the ground G where the displacement gauge 75 is fixed and the end surface 49*a* of the rotor 23, located outside the outer casing 22, is $-l_O-b$. From the equations $X_1=-l_O+a$ and $X_3=-l_O-b$, an equation $X_1-X_3=a+b$ can be derived. Furthermore, the angle of inclination $\theta_1$ can be easily calculated by using an equation for the angle of inclination $\theta_1=\tan^{-1}((a+b)/2y)$, specifically, $\theta_1=\tan^{-1}((X_1-X_3)/2y)$.

Note that y is the distance in the y direction (see FIG. 25) from the center $O_R$ of the rotor 23 to the center (base point) of the measuring part (sensor part) of each of the displacement gauges 73 and 75.

Next, a method of calculating the thermal elongation difference $\delta_2$ of the inner casing 21 with respect to the grounds G will be described with reference to FIGS. 26 and 28.

As described above, the displacement gauge 76 is a sensor for measuring the axial distance $X_4$ between the portion of the ground G where the displacement gauge 76 is fixed and the arm 27 located outside (at the outside of) the outer casing 22, and the displacement gauge 78 is a sensor for measuring an axial distance $X_6$ between the portion of the ground G where the displacement gauge 78 is fixed and the arm 79, located outside (at the outside of) the cuter casing 22. As shown in FIG. 26, in the cold state where the steam turbine ST is shut down (in the state in which the thermal elongation difference δ and/or the angle of inclination θ has not been produced), the displacement gauges 76 and 78 are installed (initially set) at positions away from the center $O_2$ the inner casing 21 by the identical distance $L_O$ in the axial direction such that pieces of data (measurement values) measured by the displacement gauges 76 and 78 become equal ($l_O$ in this embodiment), specifically, such that the axial distance $X_4$ between the portion of the ground G where the displacement gauge 76 is fixed and the arm 27 located outside (at the outside of) the outer casing 22 becomes $-l_O'$, and the axial distance $X_6$ between the portion of the ground G where the displacement gauge 78 is fixed and the arm 79, located outside (at the outside of) the outer casing 22, becomes $+l_O'$.

Next, as shown in FIG. 27, when the thermal elongation difference $\delta_2$ of the inner casing 21 constituting the steam turbine ST with respect to the grounds G is considered, the axial distance $X_4$ between the portion of the ground G where the displacement gauge 76 is fixed and the arm 27 located outside (at the outside of) the outer casing 22 is $-l_O'+\delta_2$, and the axial distance $X_6$ between the portion of the ground G where the displacement gauge 78 is fixed and the arm 79, located outside (at the outside of) the outer casing 22, is $l_O'+\delta_2$. Then, from the equations $X_4=-l_O'+\delta_2$ and $X_6=l_O'+\delta_2$, an equation for the thermal elongation difference $\delta=(X_4+X_6)/2$ can be derived. Specifically, the thermal elongation difference $\delta_2$ can be easily calculated by calculating the sum of the axial distance $X_4$ between the portion of the ground G where the displacement gauge 76 is fixed and the arm 27 located outside (at the outside of) the outer casing 22, which is measured by the displacement gauge 76, and the axial distance $X_6$ between the portion of the ground G where the displacement gauge 78 is fixed and the arm 79, located outside (at the outside of) the outer casing 22, which is measured by the displacement gauge 78, and by dividing the sum by 2. Furthermore, the thermal elongation difference δ can be easily calculated by subtracting the thermal elongation difference $\delta_2$ from the above-described thermal elongation difference $\delta_1$.

Next, as shown in FIG. 28, when a thermal elongation difference Δl' inherent to the inner casing 21 constituting the steam turbine ST is considered, the axial distance $X_4$ between the portion of the ground G where the displacement gauge 76 is fixed and the arm 27 located outside (at the outside of) the outer casing 22 is $-l_O'+\delta_2+\Delta l'$, and the axial distance $X_6$ between the portion of the ground G where the displacement gauge 78 is fixed and the arm 79, located outside (at the outside of) the outer casing 22, is $l_O'+\delta_2-\Delta l'$. Then, from the equations $X_4=-l_O'+\delta_2+\Delta l'$ and $X_6=l_O'+\delta_2-\Delta l'$, an equation for the thermal elongation difference $\delta_2=(X_4+X_6)/2$ can be derived. Specifically, the thermal elongation difference $\delta_2$ can be easily calculated by calculating the sum of the axial distance $X_4$ between the portion of the ground G where the displacement gauge 76 is fixed and the arm 27 located outside (at the outside of) the outer casing 22, which is measured by the displacement gauge 76, and the axial distance $X_6$ between the portion of the ground G where the displacement gauge 78 is fixed and the arm 79, located outside (at the outside of) the outer casing 22, which is measured by the displacement gauge 78, and by dividing the sum by 2. In this way, the thermal elongation difference $\delta_2$ can be easily calculated by using the equation $(X_4+X_2)/2$, independently of whether the thermal elongation difference Δl' inherent to the inner casing 21 constituting the steam turbine ST is considered or not.

Next, a method of calculating the angle of inclination $\theta_2$ of the inner casing 21 with respect to the grounds G will be described with reference to FIG. 29.

As described above, the displacement gauges 76 and 77 are sensors for measuring the axial distances $X_4$ and $X_5$ between the portions of the grounds G where the displacement gauges 76 and 77 are fixed and the arms 27 and 28 located outside (at the outside of) of the outer casing 22, respectively. As indicated by the two-dot chain lines in FIG. 29, in the cold state where the steam turbine ST is shut down (in the state in which the thermal elongation difference δ and/or the angle of inclination θ has not been produced), the displacement gauges 76 and 77 are installed (initially set) such that pieces of data (measurement values) measured by the displacement gauges 76 and 71 become equal ($l_o'$ in this embodiment), specifically, such that the axial distance $X_4$ between the portion of the ground G where the displacement gauge 76 is fixed and the arm 27 located outside the outer casing 22 becomes $-l_O'$, and the axial distance $X_5$ between the portion of the ground G where the displacement gauge 77 is fixed and the arm 28 located outside the outer casing 22 becomes $-l_O'$.

Next, as indicated by the solid lines in FIG. 29, if the inner casing 21 constituting the steam turbine ST is inclined with respect to the grounds G by the angle of inclination $\theta_2$, the axial distance $X_4$ between the portion of the ground G where the displacement gauge 76 is fixed and the arm 27 located outside the outer casing 22 is $-l_O'+a'$, and the axial distance $X_5$ between the portion of the ground G where the displacement gauge 77 is fixed and the arm 28 located outside the outer casing 22 is $-l_O'-b'$. From the equations $X_4=l_O'+a'$ and $X_5=-l_O'-b'$, an equation $X_4-X_5=a'+b'$ can be derived. Furthermore, the angle of inclination $\theta$ can be easily calculated by using the equation for the angle of inclination $\theta_2=\tan^{-1}((a'+b')/2y')$, specifically, $\theta_2=\tan^{-1}((X_4-X_5)/2y')$. Furthermore, the angle of inclination $\theta$ can be easily calculated by subtracting the angle of inclination $\theta_2$ from the above-described angle of inclination $\theta_1$. Then, the rods 26 of the actuators 14 and 15 are made to advance and recede such that the calculated thermal elongation difference $\delta$ and/or angle of inclination $\theta$ are cancelled out (offset: set to zero); thus, even in the hot state where the steam turbine ST is operated (in the state in which the thermal elongation difference $\delta$ and/or the angle of inclination $\theta$ has been produced), the center $O_R$ of the rotor 23 is located in a vertical plane that includes the axiswise middle (center $O_1$) of the inner casing 21, and the relative position of the inner casing 21 and the rotor 23 is maintained unchanged (so as to be stabilized).

Note that y' is the distance in the y direction (see FIG. 29) from the center $O_2$ of the inner casing 21 to the center (base point) of the measuring part (sensor part) of each of the displacement gauges 76 and 77.

According to the steam turbine casing position adjusting apparatus 60 of this embodiment, the actuators 14 and 15 are controlled such that the thermal elongation difference $\delta$ of the rotor 23 in the axial direction with respect to the inner casing 21 and/or the angle of inclination $\theta$ of the rotor 23 with respect to the inner casing 21 are cancelled out (offset: set to zero); thus, even in the hot state where the steam turbine ST is operated (in the state in which the thermal elongation difference $\delta$ and/or the angle of inclination $\theta$ has been produced), the relative position of the inner casing 21 and the rotor 23 is maintained unchanged (so as to be stabilized).

Thus, it is possible to reduce the clearance between the inner casing (turbine casing) 21 and the rotor 23 and to improve the efficiency of the turbine.

Furthermore, according to the steam turbine casing position adjusting apparatus 60 of this embodiment, inclination and a thermal elongation of the inner casing 21 with respect to the grounds G due to thermal expansion thereof are considered.

Thus, it is possible to more accurately measure the thermal elongation difference due to the relative thermal expansion of the inner casing 21 and the rotor 23, to reduce the clearance between the inner casing 21 and the rotor 23, and to improve the efficiency of the turbine.

Furthermore, according to the steam turbine casing position adjusting apparatus 60 of this embodiment, the displacement gauges 73, 74, 75, 76, 77, and 78 and the actuators 14 and 15 are provided outside the outer casing 22, so that they are not exposed to high-temperature steam.

Thus, it is possible to reduce the occurrence of thermal damage and failure of the displacement gauges 73, 74, 75, 76, 77, and 78 and the actuators 14 and 15, to lengthen the lives thereof, and to improve the reliability of the displacement gauges 73, 74, 75, 76, 77, and 78 and the actuators 14 and 15.

Furthermore, according to the steam turbine casing position adjusting apparatus 60 of this embodiment, the arms 27, 28, and 79, the displacement gauges 76, 77, and 78, and the actuators 14 and 15 are provided at positions shifted from the middle (center) of the inner casing 21 in the axial direction (horizontal direction in FIG. 21), specifically, at positions where they do not interfere with incidental equipment, such as the above-described side inlet tube.

Thus, incidental equipment, such as the above-described side inlet tube, can be laid out more freely.

Note that the present invention is not limited to the above-described embodiments, and changes in shape and modifications can be appropriately made as needed.

For example, it is more preferred that at least two sets of the displacement gauges 11, 12, and 13, described in the third embodiment, be disposed in the circumferential direction.

Thus, even if one set of the displacement gauges 11, 12, and 13 is not operating normally due to a failure or the like, the other set of the displacement gauges 11, 12, and 13, which is provided as a backup, can be used to measure the relative axial distance of the rotor 23 with respect to the inner casing 21 without any trouble.

Furthermore, it is more preferred that temperature sensors for measuring the temperatures of the inner casing 21 and the rotor 23 be provided.

Thus, calibration of the displacement gauges can be performed without removing the displacement gauges, by using thermal elongations of the inner casing 21 and the rotor that are calculated based on the temperatures measured by the temperature sensors and thermal elongations of the inner casing 21 and the rotor that are calculated based on the axial distances measured by the displacement gauges.

Sixth Embodiment

A steam turbine casing position adjusting apparatus according to a sixth embodiment of the present invention will be described below with reference to FIGS. 30 to 35.

Figure 30:
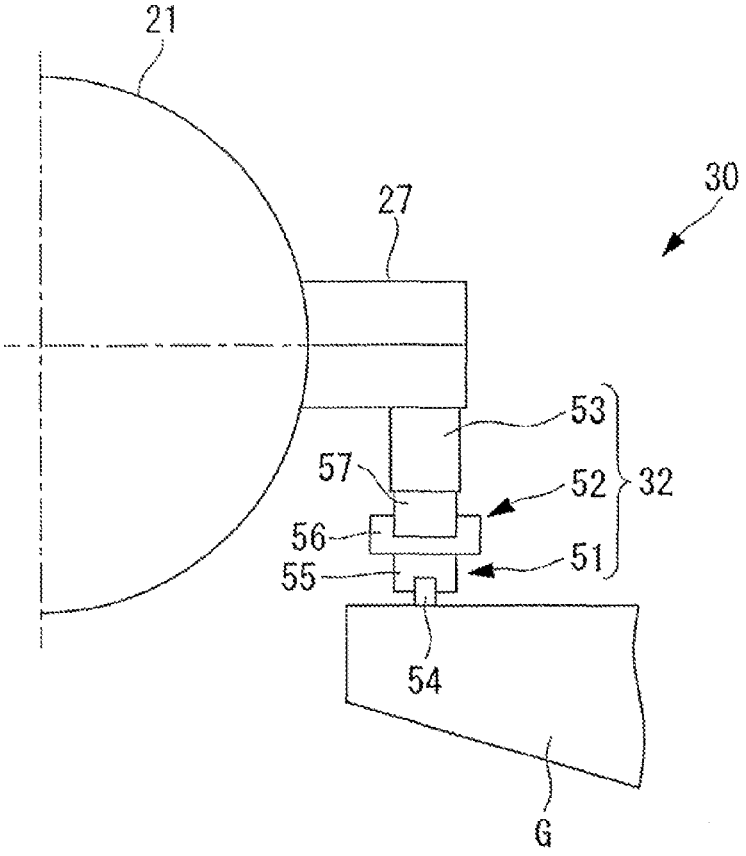
FIG. 30 is a front view showing a main portion of a steam turbine casing position adjusting apparatus according to a sixth embodiment of the present invention.
Figure 31:
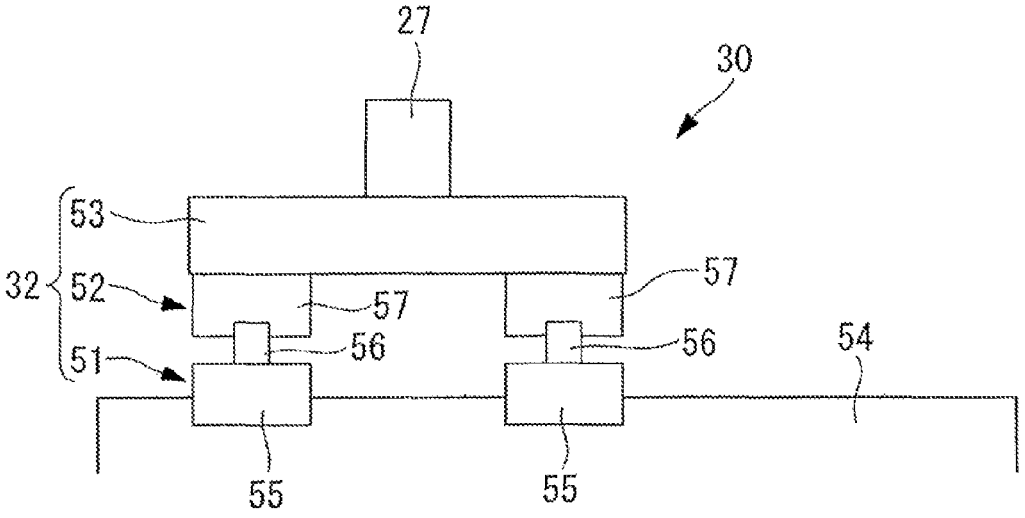
FIG. 31 is a right side view showing the main portion of the steam turbine casing position adjusting apparatus according to the sixth embodiment of the present invention.
Figure 32:
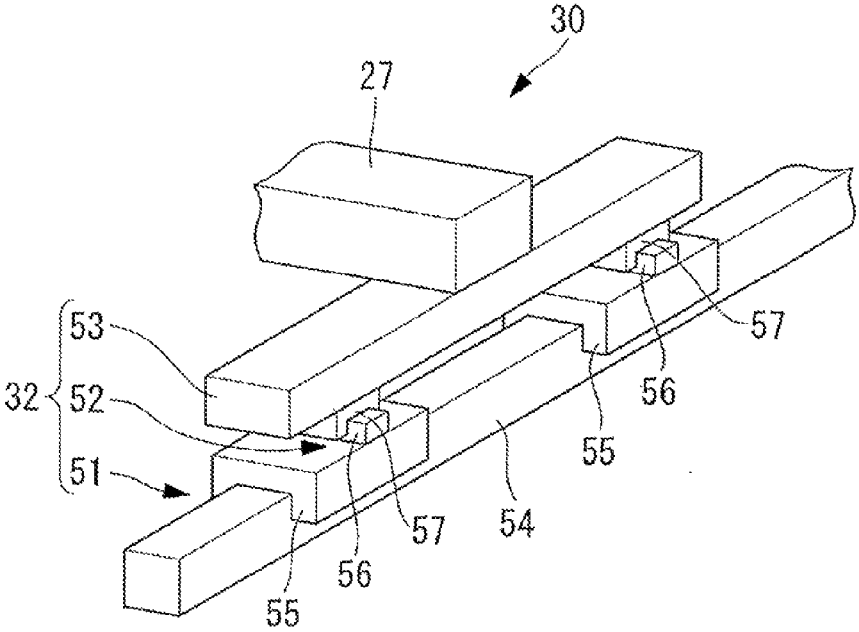
FIG. 32 is a perspective view showing the main portion of the steam turbine casing position adjusting apparatus according to the sixth embodiment of the present invention, viewed from the right side.
Figure 33:
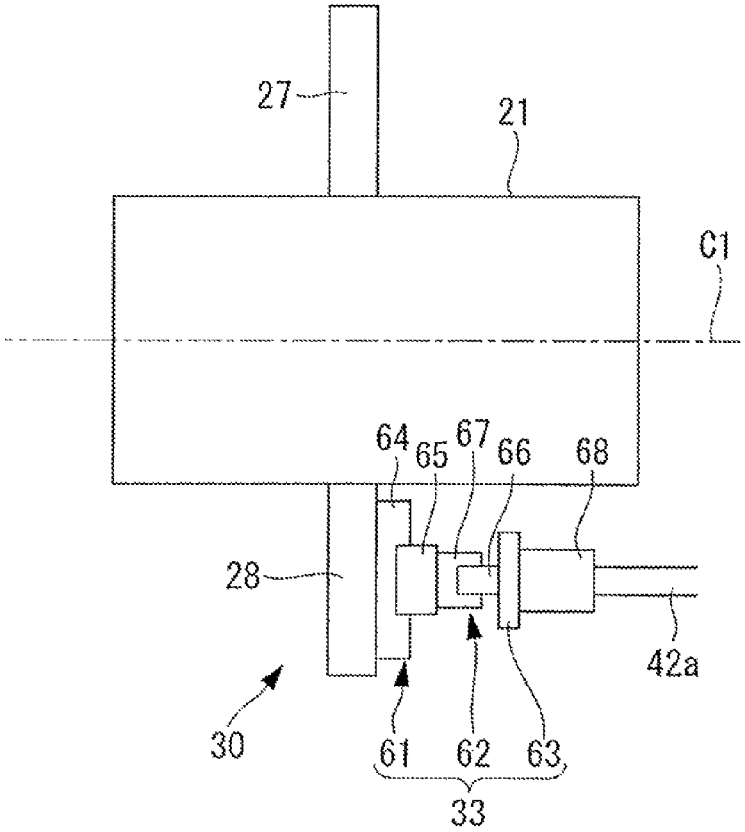
FIG. 33 is a plan view showing a main portion of the steam turbine casing position adjusting apparatus according to the sixth embodiment of the present invention.
Figure 34:
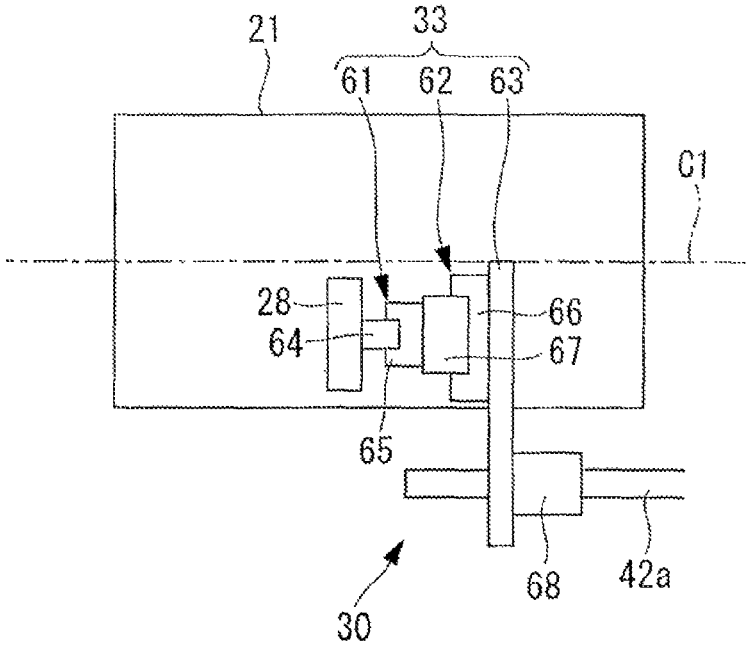
FIG. 34 is a left side view showing the main portion of the steam turbine casing position adjusting apparatus according to the sixth embodiment of the present invention.
Figure 35:
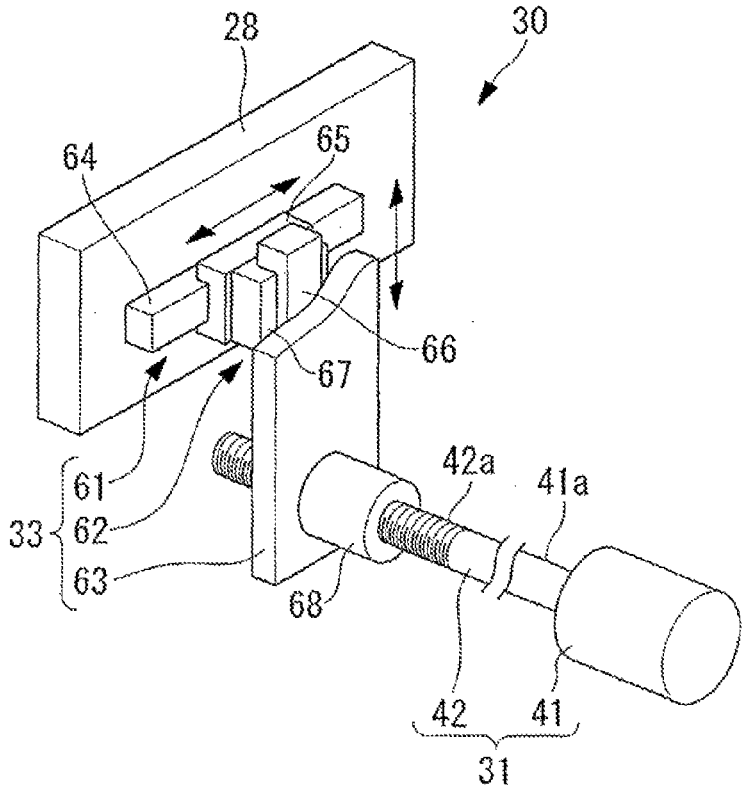
FIG. 35 is a perspective view showing the main portion of the steam turbine easing position adjusting apparatus according to the sixth embodiment of the present invention, viewed from the left side.

FIG. 30 is a front view showing a main portion of the steam turbine casing position adjusting apparatus of this embodiment. FIG. 31 is a right side view showing the main portion of the steam turbine casing position adjusting apparatus of this embodiment. FIG. 32 is a perspective view showing the main portion of the steam turbine casing position adjusting apparatus of this embodiment, viewed from the right side. FIG. 33 is a plan view showing a main portion of the steam turbine casing position adjusting apparatus of this embodiment. FIG. 34 is a left side view showing the main portion of the steam turbine casing position adjusting apparatus of this embodiment. FIG. 35 is a perspective view showing the main portion of the steam turbine casing position adjusting apparatus of this embodiment, viewed from the left side.

As shown in at least one of FIGS. 30 to 35, a steam turbine casing position adjusting apparatus 30 according to this embodiment includes at least one actuator 31 (in this embodiment, two actuators 31), two supporting units 32 that support the above-described arms 27 and 28, and at least one coupling unit 33 (in this embodiment, two coupling units 33) that couples the actuator(s) 31 with the arms 27 and 28.

The actuators 31 are fixed to the outer casing 22 provided (disposed) so as to surround the circumference (outer side) of the inner casing 21 (or fixed to the grounds G (see FIG. 30 etc.) on which the outer casing 22 is installed), and move the inner casing 21 in the axial direction with respect to the outer casing 22 and the rotor 23. As shown in FIG. 35, the actuators 31 each include a motor 41 and a ball screw 42 that rotates together with a rotating shaft 41*a* of the motor 41.

As shown in at least one of FIGS. 30 to 32, the supporting units 32 each include a (first) linear guide (axial-direction guide) 51, a (second) linear guide (radial-direction guide) 52, and a connecting member (intermediate member) 53.

The linear guide 51 is a slide bearing that guides the arm 27 or 28 (specifically, the inner casing 21) in the axial direction of the inner casing 21 and includes a rail 54 and blocks (reciprocating bodies) 55.

The rail 54 guides the blocks 55 in the axial direction of the inner casing 21 and is fixed to the upper surface of the ground G so as to be parallel to the central line C1 (see FIG. 38 etc.) of the outer casing 22.

The blocks 55 are disposed on the rail 54 and reciprocate on the rail 54 in the axial direction of the inner casing 21, and, in this embodiment, the two blocks 55 are disposed in the longitudinal direction of the rail 54.

The linear guide 52 is a slide bearing that guides the arm 27 or 28 (specifically, the inner casing 21) in the radial direction of the inner casing 21 and includes rails 56 and blocks (reciprocating bodies) 57.

The rails 56 guide the blocks 57 in the radial direction of the inner casing 21 and are fixed on the upper surfaces of the blocks 55 (more specifically, on the upper surfaces at the middle portions of the blocks 55 in the longitudinal direction) so as to be perpendicular to the central line C1 (see FIG. 38 etc.) of the inner casing 21.

The blocks 57 are disposed on the rails 56 and reciprocate on the rails 56 in the radial direction of the inner casing 21, and the blocks 57 are provided on the respective rails 56.

The connecting member 53 connects the arm 27 or 28 to the blocks 57 and is fixed to the upper surfaces of the blocks 57 so as to bridge between the blocks 57, which are disposed in the axial direction of the inner casing 21, specifically, so as to be parallel to the central line C1 (see FIG. 38 etc.) of the inner casing 21.

Like the supporting units 32, the coupling units 33 each include a (first) linear guide (horizontal-direction guide) 61, a (second) linear guide (height-direction guide) 62, and a connecting member (intermediate member) 63.

The linear guide 61 is a slide bearing that guides the arm 27 or 28 (specifically, the inner casing 21) in the radial direction of the inner casing 21 and includes a rail 64 and a block (reciprocating body) 65.

Figure 38:
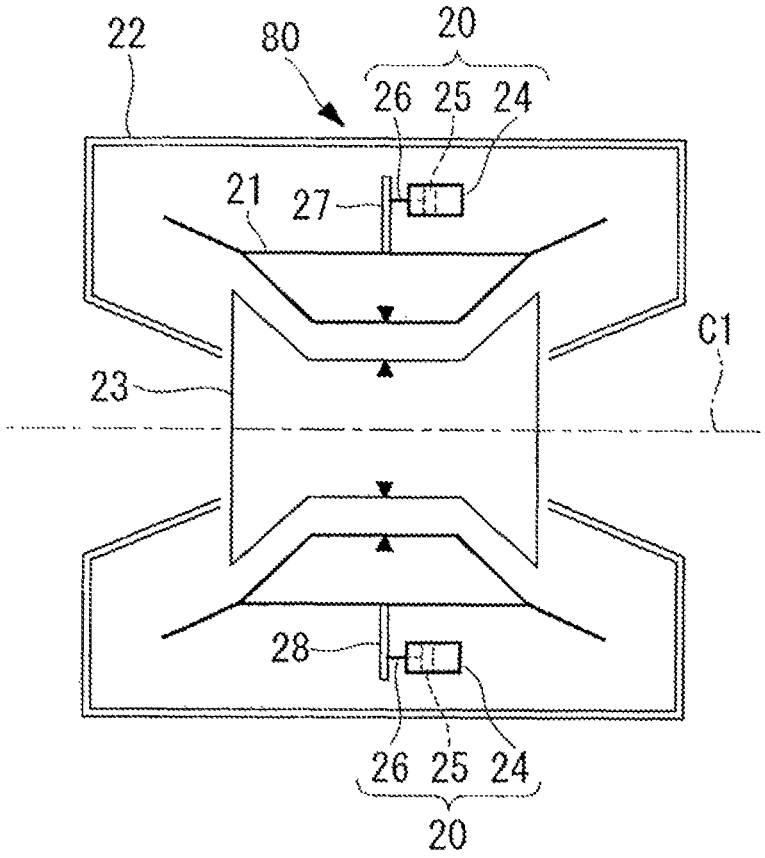
FIG. 38 is a plan view for explaining a problem in conventional technologies.

The rail 64 guides the block 65 in the radial direction of the inner casing 21 and is fixed to one end surface of the arm 27 or 28 in the axial direction (in this embodiment, to an end surface of the arm 27 or 28 where the motor 41 is disposed: to the right end surface of the arm 27 or 23 in FIG. 33 and FIG. 34), so as to be perpendicular to the central line C1 (see FIG. 38 etc. of the inner casing 21.

The block 65 reciprocates in the radial direction of the inner casing 21 along (by being guided by) the rail 64. Blocks 65 are provided on right and left sides in this embodiment.

The linear guide 62 is a slide bearing that guides the arm 27 or 28 (specifically, the inner casing 21) in the height direction (vertical direction) of the inner casing 21 and includes a rail 66 and a block (reciprocating body) 67.

The rail 66 guides the block 67 in the height direction of the inner casing 21 and is fixed to one end surface of a connecting member 63 in the axial direction (plate thickness direction) (in this embodiment, to the end surface opposite to the surface of the connecting member 63 where the motor 41 is disposed: the left end surface of the connecting member 63 in FIG. 33 and FIG. 34), the connecting member 63 being perpendicular to the central line C1 (see FIG. 38 etc.) of the inner casing 21 and extending in the height direction of the inner casing 21.

The block 67 reciprocates in the height direction of the inner casing 21 along (by being guided by) the tail 66. Blocks 67 are provided on right and left sides in this embodiment. Furthermore, the block 65 and the block 67 are bonded (fixed) such that their back surfaces (surfaces that face each other) are brought into contact.

The connecting member 63 is a plate-shaped member for connecting the ball screw 42 and the rail 66 and is perpendicular to the central line C1 (see FIG. 38 etc.) of the inner casing 21 and extends in the height direction of the inner casing 21. Furthermore, the connecting member 63 has, at one end portion thereof (in this embodiment, the lower half portion), a through-hole (not shown) that penetrates the connecting member 63 in the plate thickness direction and into which the ball screw 42 is inserted and a cylindrical part 68 that communicates with the through-hole and that has an internal thread part (not shown) provided on its inner peripheral surface, the internal thread part being screwed together with an external thread part 42*a* provided on the outer peripheral surface of the ball screw 42. Then, when the ball screw 42 is rotated forward or rotated backward by the motor 41 to move the connecting member 63 in the axial direction of the inner casing 21, the arm 27 or 28 (specifically, the inner casing 21) is moved in the axial direction of the inner casing 21, thus adjusting the clearance between the inner casing 21 and the rotor 23.

Note that FIGS. 30 to 32 show only the arm 27 and the supporting unit 32 that is disposed on the arm 27 and do not show the arm 28 and the supporting unit 32 that is disposed on the arm 28.

Furthermore, FIGS. 33 to 35 show only the arm 28 and the coupling unit 33 that is disposed on the arm 28, and FIGS. 33 to 35 do not show the arm 27 and the coupling unit 33 that is disposed on the arm 27.

According to the steam turbine casing position adjusting apparatus 30 of this embodiment, a thermal elongation of the inner casing 21 in the radial direction due to thermal expansion thereof can be permitted (absorbed).

Furthermore, according to the steam turbine casing position adjusting apparatus 30 of this embodiment, a thermal elongation of the inner casing 21 in the horizontal direction due to thermal expansion thereof is permitted by the (first) linear guide 61, and a thermal elongation of the inner casing 21 in the height direction due to thermal expansion thereof is permitted by the (second) linear guide 62.

Thus, it is possible to avoid a situation in which an excess load is applied to a joint part of the inner casing 21 and the actuator 31, preventing the joint part of the inner casing 21 and the actuator 31 from being damaged.

Note that the present invention is not limited to the above-described embodiment, and changes in shape and modifications can be appropriately made as needed.

Figure 36:
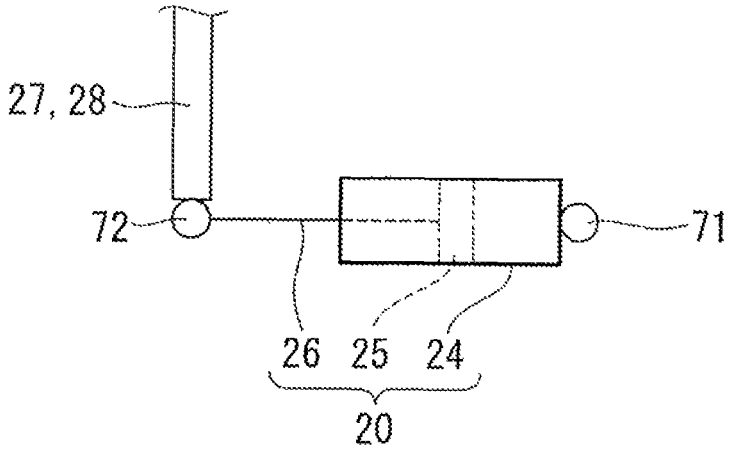
FIG. 36 is a plan view showing a main portion of a steam turbine casing position adjusting apparatus according to a seventh embodiment of the present invention.

For example, as shown in FIG. 36, an actuator 20 may be adopted instead of the actuator 31, the cylinder 24 of the actuator 20 may be connected to the outer casing 22 to which the cylinder 24 is to be fixed (or to the ground G on which the outer casing 22 is installed), by a (first) ball joint 71, and the distal end of the rod 26 may be connected to the arm 27 or 28 by a (second) ball joint 72.

Furthermore, in the above-described embodiment, a description has been given of a concrete example where the actuator 31, the supporting unit 32, and the coupling unit 33 are provided for both of the arms 27 and 28; however, the present invention is not limited to this structure, and the actuator 31 and the coupling unit 33 may be provided for only one of the arms 27 and 28.

Furthermore, in the above-described embodiment, a description has been given of a concrete example where the steam turbine includes both the outer casing and the inner casing, serving as turbine casings; however, the steam turbine casing position adjusting apparatus according to the present invention can be applied to a steam turbine that does not include an inner casing inside the outer casing (that does not include an outer casing outside the inner casing), specifically, a steam turbine that has only one casing serving as a turbine casing.

Furthermore, the type of the linear guides 51, 52, 61, and 62 of the above-described embodiment is not limited to a slide bearing and can be any type of bearing (for example, rolling bearing), as long as the bearing travels in a straight line.

Figure 37:
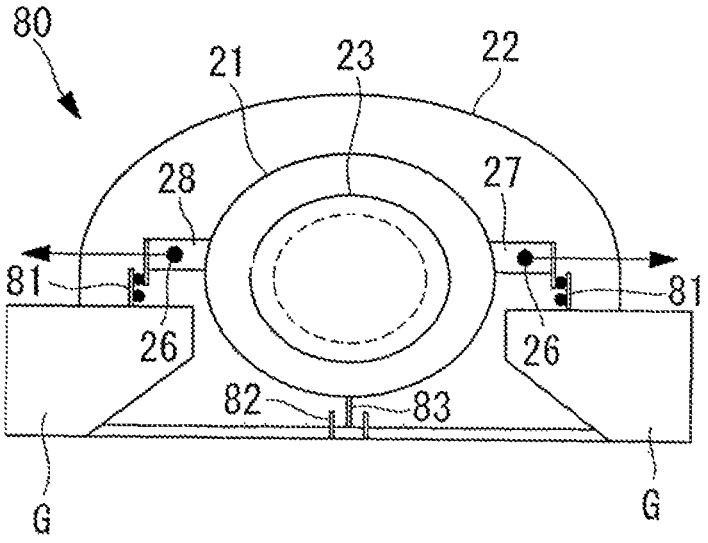
FIG. 37 is a cross-sectional view for explaining a problem in conventional technologies.

Furthermore, it is more preferred that a bearing (not shown) that travels in a straight line (for example, a slide bearing or a rolling bearing) be disposed between an axial-direction guide 82 and a convex portion 83 shown in FIG. 37.

Thus, it is possible to reduce the coefficient of friction generated between the axial-direction guide 82 and the convex portion 83, to prevent a portion between the axial-direction guide 82 and the convex portion 83 from being burnt out, and to reduce a required thrust of the actuator 31.

Furthermore, it is more preferred that the actuator 20 or 31 be provided outside the outer casing 22, so that it is not exposed to high-temperature steam.

According to the steam turbine casing position adjusting apparatus, it is possible to reduce the occurrence of thermal damage and failure of the actuator 20 or 31, to lengthen the life thereof, and to improve the reliability of the actuator 20 or 31.

REFERENCE SIGNS LIST

10, 30, 40, 60 steam turbine casing position adjusting apparatus
11, 12, 13, 73, 74, 75, 76, 77, 78 displacement gauge (sensor)
14, 15, 31 actuator
21 inner casing (turbine casing)
22, 37 outer casing (turbine casing)
23 rotor
23*a* end surface (measurement surface)
23*b* end surface (measurement surface)
26 rod
27, 28, 47, 48 arm
32 supporting unit
33 coupling unit
34 calculator
35 controller
43 recess
49*a* end surface (measurement surface
50*a* end surface (measurement surface)
51 (first) linear guide (axial-direction guide)
52 (second) linear guide (radial-direction guide)
61 (first) linear guide (horizontal-direction guide)
62 (second) linear guide (height-direct ion guide)
G ground
ST steam turbine
δ thermal elongation difference
θ angle of inclination

The invention claimed is:

1. A steam turbine casing position adjusting apparatus comprising:
a rotor;
an inner casing that is disposed coaxially with the rotor;
an outer casing that is disposed so as to surround an outer side of the inner casing; and
an actuator that moves the inner casing in an axial direction with respect to the rotor;
at least three sensors that are fixed to the inner casing or a ground on which the outer casing is installed; and
a controller configured to control the actuator based on data from the at least three sensors such that the relative position relation between the inner casing and the rotor is maintained by canceling a thermal elongation difference of the rotor in the axial direction with respect to the inner casing and an angle of inclination of the rotor with respect to the inner casing,
wherein the actuator is disposed radially outside an outer peripheral surface forming the inner casing.

2. A steam turbine casing position adjusting apparatus comprising:
an outer casing;
an inner casing;
a rotor; and
an actuator that moves the inner casing in an axial direction,
wherein the steam turbine casing position adjusting apparatus further comprises:
at least three sensors that are fixed to the inner casing or a ground on which the outer casing is installed; and
a controller configured to control the actuator based on data from the at least three sensors such that a relative position relation between the inner casing and the rotor is maintained by canceling a thermal elongation difference of the rotor in the axial direction with respect to the inner casing and an angle of inclination of the rotor with respect to the inner casing,
wherein the actuator is disposed radially outside an outer peripheral surface forming the inner casing and radially inside an inner peripheral surface forming the outer casing.

3. A steam turbine casing position adjusting apparatus comprising:
an outer casing;
an inner casing;
a rotor; and
an actuator that moves the inner casing in an axial direction,
wherein the steam turbine casing position adjusting apparatus further comprises:
at least three sensors that are fixed to the inner casing or a ground on which the outer casing is installed; and
a controller configured to control the actuator based on data from the at least three sensors such that the relative position relation between the inner casing and the rotor is maintained by canceling a thermal elongation difference of the rotor in the axial direction with respect to the inner casing and an angle of inclination of the rotor with respect to the inner casing,
wherein the actuator is disposed radially outside an outer peripheral surface forming the outer casing.

4. A steam turbine casing position adjusting apparatus according to claim 3, wherein the actuator is disposed in a recess that is provided in a circumferential direction at an axiswise middle portion of the outer casing.

5. A steam turbine casing position adjusting apparatus according to claim 2, wherein a distal end of a rod constituting the actuator is connected to an arm that is fixed to a portion of an outer peripheral surface of the inner casing that is located at an axiswise middle of the inner casing and that extends toward a radially outer side of the inner casing.

6. A steam turbine casing position adjusting apparatus according to claim 1, wherein one of the at least three sensors is a first sensor provided inside the inner casing and the first sensor measures an axial distance between an axiswise middle of the inner casing and a measurement surface of the rotor.

7. A steam turbine casing position adjusting apparatus according to claim 1, wherein:

the at least three sensors includes a second sensor that measures a relative distance of the inner casing in the axial direction with respect to the ground on which the outer casing is installed and a third sensor that measures a relative distance of the rotor in the axial direction with respect to the ground; and the controller outputs a command signal, based on data from the second sensor and/or the third sensor, for controlling the actuator such that the relative position relation between the inner casing and the rotor is maintained by canceling a thermal elongation difference of the inner casing in the axial direction with respect to the ground, an angle of inclination of the inner casing with respect to the ground, a thermal elongation difference of the rotor in the axial direction with respect to the ground, and an angle of inclination of the rotor with respect to the ground.

8. A steam turbine casing position adjusting apparatus according to claim 7, wherein the first sensor, the second sensor, the third sensor, and the actuator are provided outside the outer casing.

9. A steam turbine casing position adjusting apparatus according to claim 2, wherein the inner casing is supported on the outer casing or on a ground on which the outer casing is fixed, via a supporting unit that comprises a radial-direction guide that permits a thermal elongation of the inner casing in a radial direction due to thermal expansion thereof and an axial-direction guide that permits movement of the inner casing in the axial direction.

10. A steam turbine casing position adjusting apparatus according to claim 9, wherein the inner casing and the actuator are coupled via a coupling unit that comprises a horizontal-direction guide that permits a thermal elongation of the inner casing in a horizontal direction due to thermal expansion thereof and a height-direction guide that permits a thermal elongation of the inner casing in a height direction due to thermal expansion thereof.

11. A steam turbine casing position adjusting apparatus according to claim 9, wherein the actuator is provided outside the outer casing.

12. A steam turbine comprising a steam turbine casing position adjusting apparatus according to claim 1.

* * * * *